US007464698B2

(12) United States Patent
Maegawa

(10) Patent No.: US 7,464,698 B2
(45) Date of Patent: Dec. 16, 2008

(54) AIR-FUEL RATIO CONTROL APPARATUS OF INTERNAL COMBUSTION ENGINE

(75) Inventor: Yoshinori Maegawa, Obu (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/729,923

(22) Filed: Mar. 30, 2007

(65) Prior Publication Data

US 2007/0251509 A1 Nov. 1, 2007

(30) Foreign Application Priority Data

Apr. 26, 2006 (JP) ..... 2006-122582
Jun. 1, 2006 (JP) ..... 2006-153854

(51) Int. Cl.
*F02M 33/02* (2006.01)

(52) U.S. Cl. ..... 123/519; 123/520

(58) Field of Classification Search ..... 123/519–520, 123/198 D; 73/114.31, 114.32, 114.39
See application file for complete search history.

(56) References Cited

U.S. PATENT DOCUMENTS 5,529,047 A 6/1996 Aota et al.
6,250,288 B1 * 6/2001 Fritz ..... 123/520
6,761,154 B2 * 7/2004 Takagi et al. ..... 123/520
6,971,375 B2 * 12/2005 Amano et al. ..... 123/520
7,107,759 B2 * 9/2006 Annoura et al. ..... 60/283
7,216,637 B2 * 5/2007 Uchida et al. ..... 123/520
7,219,660 B2 * 5/2007 Amano et al. ..... 123/520
7,234,450 B1 * 6/2007 Takakura et al. ..... 123/494
7,246,608 B2 * 7/2007 Kano et al. ..... 123/519
7,284,530 B2 * 10/2007 Nagasaki et al. ..... 123/198 D
7,316,225 B2 * 1/2008 Murakami ..... 123/520
7,316,228 B2 * 1/2008 Maegawa et al. ..... 123/698
7,318,425 B2 * 1/2008 Kano et al. ..... 123/520
7,331,335 B2 * 2/2008 Okuda ..... 123/520
7,341,048 B2 * 3/2008 Koyama et al. ..... 123/518
7,347,194 B2 * 3/2008 Sato ..... 123/520
7,370,642 B2 * 5/2008 Amano et al. ..... 123/520
7,373,929 B2 * 5/2008 Amano et al. ..... 123/491
7,383,826 B2 * 6/2008 Kano et al. ..... 123/518
7,389,769 B2 * 6/2008 Amano et al. ..... 123/520
7,409,947 B2 * 8/2008 Koyama ..... 123/520

FOREIGN PATENT DOCUMENTS

JP 5-18326 1/1993

OTHER PUBLICATIONS

U.S. Appl. No. 11/706,405, filed Feb. 2007, Maegawa et al.

* cited by examiner

*Primary Examiner*—Hai H Huynh
(74) *Attorney, Agent, or Firm*—Nixon & Vanderhye PC

(57) ABSTRACT

There is provided an air-fuel ratio control apparatus of an internal combustion engine capable of learning an air-fuel ratio and performing purge at the same time. When purge is being performed, in an air-fuel ratio learning routine, an air-fuel ratio deviation between an air-fuel ratio detected by an air-fuel ratio sensor and a target air-fuel ratio is computed by the use of a fuel vapor concentration detected in a concentration detection routine and then a learning correction value flaf to correct the computed air-fuel ratio deviation is computed.

3 Claims, 17 Drawing Sheets

| Ne \ TA | 38 | 49 | 59 | 69 | 79 | 86 | 100% |
|---|---|---|---|---|---|---|---|
| 800 | 20.1 | 14.5 | 11.2 | 8.6 | 6.2 | 4.6 | 0.0 |
| 1200 | 12.5 | 9.3 | 7.2 | 5.5 | 4.0 | 2.9 | 0.0 |
| 1600 | 9.3 | 6.8 | 5.3 | 4.0 | 2.9 | 2.1 | 0.0 |
| 2000 | 7.9 | 5.7 | 4.4 | 3.3 | 2.4 | 1.8 | 0.0 |
| 2400 | 6.0 | 4.5 | 3.5 | 2.6 | 1.9 | 1.4 | 0.0 |
| 2800 | 5.5 | 4.1 | 3.1 | 2.3 | 1.7 | 1.2 | 0.0 |
| 3200 | 4.9 | 3.6 | 2.7 | 2.0 | 1.5 | 1.1 | 0.0 |
| 3600 | 4.1 | 3.0 | 2.2 | 1.7 | 1.3 | 0.9 | 0.0 |
| 4000 | 3.4 | 2.4 | 1.8 | 1.4 | 1.1 | 0.8 | 0.0 |

AIR-FUEL RATIO CONTROL APPARATUS OF INTERNAL COMBUSTION ENGINE

CROSS-REFERENCE TO RELATED APPLICATION

This application is based on Japanese Patent Applications No. 2006-122582 filed on Apr. 26, 2006, and No. 2006-153854 filed on Jun. 1, 2006, the disclosures of which are incorporated herein by reference.

BACKGROUND OF THE INVENTION

1. Field of the Invention

The present invention relates to an air-fuel ratio control apparatus of an internal combustion engine.

2. Description of the Related Art

According to Japanese Patent No. 3404872 (U.S. Pat. No. 5,529,047), for example, when the learning completion conditions of learning an air-fuel ratio are not satisfied for a certain period, the learning of the air-fuel ratio is temporarily stopped and purge is forcibly performed. With this, when purge is stopped for a long time, it is prevented that because the quantity of adsorption of a canister reaches a saturated state, the adsorption becomes impossible from that time.

In the foregoing conventional technology, when purge is performed while the air-fuel ratio is being learned, it is impossible to discriminate whether a deviation between the air-fuel ratio detected by an air-fuel sensor or the like and a target air-fuel ratio is caused by performing the purge or by the other factor (for example, individual difference of an injector or the like), so the learning of the air-fuel ratio is temporarily stopped and purge is forcibly performed.

However, if it is possible to discriminate whether the foregoing deviation is caused by performing the purge or by the other factor, the purge can be performed while the learning of the air-fuel ratio is not temporarily stopped. In other words, the learning of the air-fuel ratio and the purge can be performed at the same time.

SUMMARY OF THE INVENTION

The present invention has been made in view of the foregoing problem. It is an object of the present invention to provide an air-fuel ratio control apparatus of an internal combustion engine capable of performing learning of an air-fuel ratio and purge at the same time.

Moreover, it is another object of the present invention to provide an air-fuel ratio control apparatus of an internal combustion engine capable of quickly measuring information required to control a flow rate of an air-fuel mixture to be introduced from a canister into an intake pipe without reducing the accuracy of flow rate control of the air-fuel mixture.

An air-fuel ratio control apparatus of an internal combustion engine in accordance with the present invention includes a canister for temporarily adsorbing fuel vapor, fuel state detection means for detecting a fuel state in an air-fuel mixture desorbed from the canister, an air-fuel ratio sensor for detecting an air-fuel ratio of an exhaust gas, air-fuel ratio learning means for correcting an air-fuel ratio deviation, and air-fuel ratio control means for controlling a fuel injection quantity.

The fuel state detection means includes measurement passage switching means and fuel state computation means. The measurement passage switching means switches between a first measurement state in which a measurement passage is opened to an atmosphere to change gas flowing through the measurement passage to air and a second measurement state in which the measurement passage is made to communicate with the canister to change the gas flowing through the measurement passage to the air-fuel mixture containing the fuel vapor from the canister. The fuel state computation means computes a fuel state in the air-fuel mixture on the basis of a first pressure measured by the pressure measurement means at the time of the first measurement state and a second pressure measured by the pressure measurement means at the time of the second measurement state. The air-fuel ratio learning means learns the air-fuel ratio by the use of the fuel state detected by the fuel state detection means when the purge performing means is performing purge.

In this manner, the present invention makes it possible to learn the air-fuel ratio, by the use of the fuel state detected by the fuel state detection means, even when purge is being performed. In other words, if the fuel state in the air-fuel mixture is detected by the fuel state detection means, even if purge is performed after the fuel state is detected, it is possible to discriminate whether an air-fuel ratio deviation between an air-fuel ratio detected by the air-fuel ratio sensor and a target air-fuel ratio is caused by performing purge or a factor other than performing purge (for example, individual difference of an injector for injecting fuel into the internal combustion engine). Accordingly, it is possible to perform purge while learning the air-fuel ratio without temporarily stopping learning the air-fuel ratio like the conventional technology (in other words, it is possible to learn the air-fuel ratio and to perform purge at the same time).

An evaporated fuel processing apparatus in accordance with the present invention includes: space volume information determination means for determining space volume information corresponding to a space volume in a fuel tank; storage means for storing a relationship between the space volume information and a stabilization time of pressure in the fuel tank, the relationship being a relationship in which as the space volume in the fuel tank becomes larger, the stabilization time becomes longer; and stabilization time determination means for determining the stabilization time on the basis of the space volume information actually determined by the space volume information determination means when a pressure change quantity in an air-fuel mixture is measured and the relationship stored in the storage device. When the time that elapses after a measurement state is achieved becomes larger than the stabilization time determined by the stabilization time determination means, the measurement state being a state in which the air-fuel mixture passes through a restrictor, pressure detection means for detecting a pressure change in the air-fuel mixture detects a pressure change quantity in the air-fuel mixture.

DETAILED DESCRIPTION OF THE PREFERRED EMBODIMENTS

Figure 1:
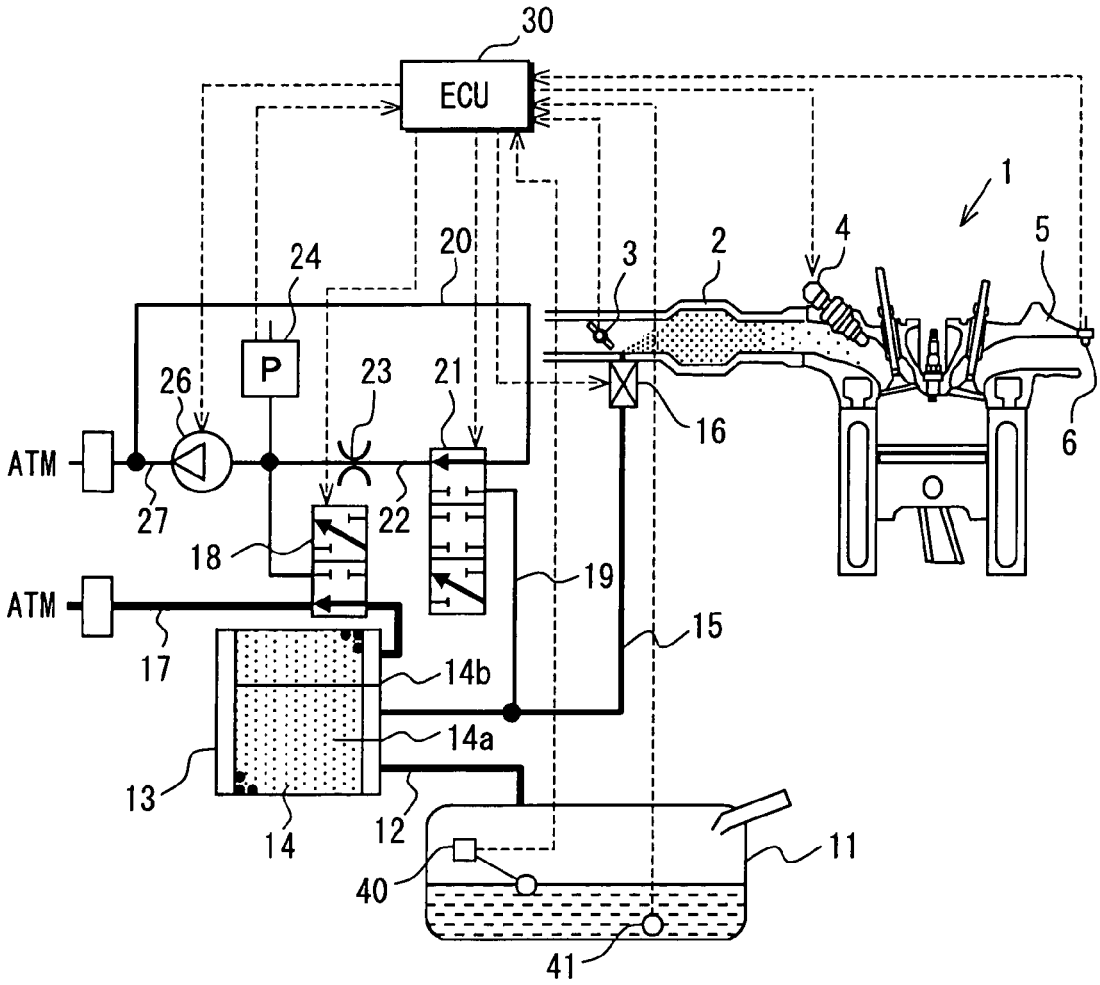
FIG. 1 is a construction diagram showing the construction of an air-fuel ratio control apparatus in an embodiment of the present invention.

The preferred embodiments of the present invention will be described below. FIG. 1 is a construction diagram showing the construction of an air-fuel ratio control apparatus according to an embodiment of the present invention. The air-fuel ratio control apparatus according to this embodiment is applied, for example, to the engine of an automobile. A fuel tank 11 of an engine 1 is connected to a canister 13 via an evaporation line 12 of an introduction passage.

The canister 13 is filled with an adsorbent material 14. The adsorbent material 14 temporarily adsorbs fuel vapor generated in the fuel tank 11. The canister 13 is connected to an intake pipe 2 of the engine 1 via a purge line 15 of a purge pipe. The purge line 15 is provided with a purge valve 16 as a purge control valve, and when the purge valve 16 is opened, the canister 13 communicates with the intake pipe 2.

A partition plate 14*a* is disposed in the canister 13. The partition plate 14*a* is disposed between the connection position of the evaporation line 12 and the connection position of the purge line 15 and prevents the fuel vapor introduced from the evaporation line 12 from being purged from the purge line 15 without being adsorbed by the adsorbent material 14. Moreover, an atmosphere line 17 is also connected to the canister 13, as will be described later, and a partition plate 14*b* is disposed in the canister 13. The partition plate 14*b* is disposed between the connection position of the atmosphere line 17 and the connection position of the purge line 15 in the substantially same depth as the packing depth of the adsorbent material 14. This prevents the fuel vapor introduced from the evaporation line 12 from being purged from the atmosphere line 17.

The purge valve 16 is a solenoid valve and has its opening controlled by an electronic control unit (ECU) 30 for controlling the respective parts of the engine 1. The flow rate of an air-fuel mixture containing the fuel vapor flowing in the purge line 15 is controlled by the opening of the purge valve 16, and the air-fuel mixture having its flow rate controlled is purged into the intake pipe 2 by a negative pressure developed in the intake pipe 2 by a throttle valve 3 and is combusted together with fuel injected from an injector 4 (hereinafter, the air-fuel mixture to be purged and containing the fuel vapor is, as appropriate, referred to as purge gas).

The canister 13 has the atmosphere line 17 connected thereto, the tip of the atmosphere line 17 opening to the atmosphere via a filter. The atmosphere line 17 is provided with a selector valve 18 for making the canister 13 communicate with the atmosphere line 17 or the suction side of a pump 26. Here, when the selector valve 18 is not operated by the ECU 30, the selector valve 18 is set at a first position in which the canister 13 is made to communicate with the atmosphere line 17, and when the selector valve 18 is operated by the ECU 30, the selector valve 18 is switched to a second position in which the canister 13 is made to communicate with the suction side of the pump 26.

A branch line 19 branched from the purge line 15 is connected to one input port of a three-position valve 21. Moreover, an air supply line 20 branched from a discharge line 27 of the pump 26 opening to the atmosphere via a filter is connected to the other input port of the three-position valve 21. A measurement line 22 of a measurement passage is connected to an output port of the three-position valve 21.

The three-position valve 21 is switched by the ECU 30 to any one of a first position in which the air supply line 20 is connected with the measurement line 22, a second position in which both of the connection of the air supply line 20 to the measurement line 22 and the connection of the branch line 19 to the measurement line 22 are interrupted, and a third position in which the branch line 19 is connected to the measurement line 22. Here, when the three-position valve 21 is not operated, the three-position valve 21 is set at the first position.

The measurement line 22 is provided with a restrictor 23 and the pump 26. The pump 26 is an electrically operated pump. When the pump 26 is operated, gas is sucked from the restrictor 23 and is flowed into the measurement line 22. The pump 26 is turned on or off and has the number of revolutions controlled by the ECU 30. When the ECU 30 operates the pump 26, the ECU 30 controls the pump 26 so as to hold the number of revolutions constant at a previously set specified value.

Figure 2:
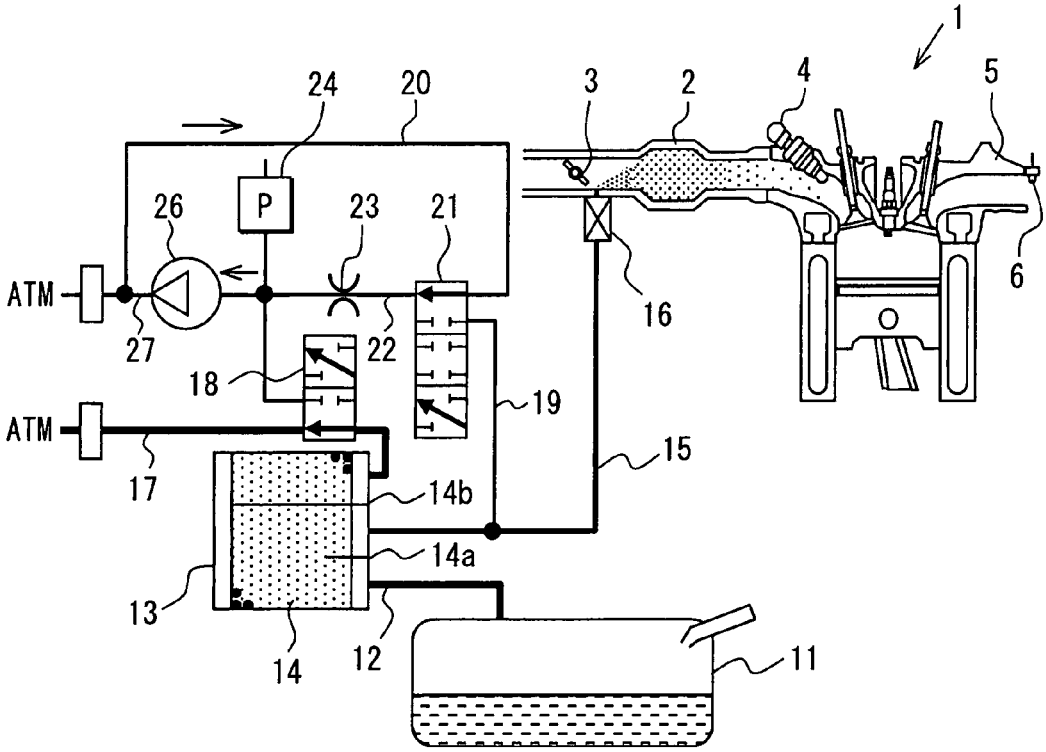
FIG. 2 is a diagram to illustrate a first measurement state.
Figure 3:
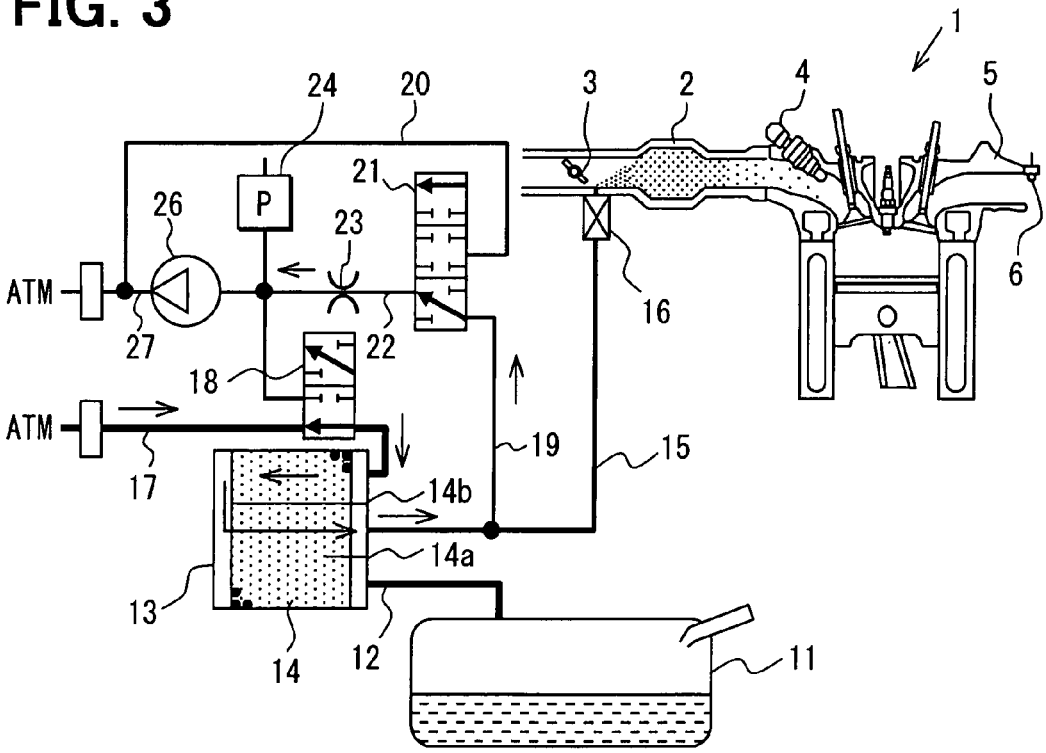
FIG. 3 is a diagram to illustrate a second measurement state.

Thus, as shown in FIG. 2, when the ECU 30 operates the pump 26 in a state in which the three-position valve 21 is set to the first position with the selector valve 18 held set to the first position, there is brought about "a first measurement state" in which air flows in the measurement line 22. Moreover, when the ECU 30 operates the pump 26 in a state in which the three-position valve 21 is set to the third position, as shown in FIG. 3, there is brought about "a second measurement state" in which an air-fuel mixture containing the fuel vapor and supplied via the atmosphere line 17, the canister 13, a portion of the purge line 15 to the branch line 19, and the branch line 19 flows in the measurement line 22.

Moreover, in the measurement line 22, one end of a pressure sensor 24 of pressure measuring means is connected on the downstream side of the restrictor 23, that is, between the restrictor 23 and the pump 26. The other end of the pressure sensor 24 opens to the atmosphere, and the pressure sensor 24 detects a differential pressure between the atmospheric pressure and pressure in a downstream position from the restrictor 23 in the measurement line 22. The differential pressure measured by the pressure sensor 24 is outputted to the ECU 30. Moreover, the ECU 30 is also supplied with the output values of fuel remaining quantity level sensor 40 and a fuel temperature sensor 41 of fuel temperature determination means.

The ECU 30 controls the opening of the throttle valve 3 that is disposed in the intake pipe 2 and controls an intake air volume, the fuel injection quantity from the injector 4, and the opening of the purge valve 16 on the basis of detection values detected by various sensors. For example, the ECU 30 controls the opening of the throttle valve 3, the fuel injection quantity, and the opening of the purge valve 16 on the basis of an intake air volume detected by an air flow sensor disposed in the intake pipe 2, an intake air pressure detected by an intake air pressure sensor (not shown), an air-fuel ratio detected by an air-fuel ratio sensor 6 disposed in the exhaust pipe 5, an ignition signal, the number of revolutions of the engine, an engine cooling water temperature, an accelerator position, and the like.

Figure 4:
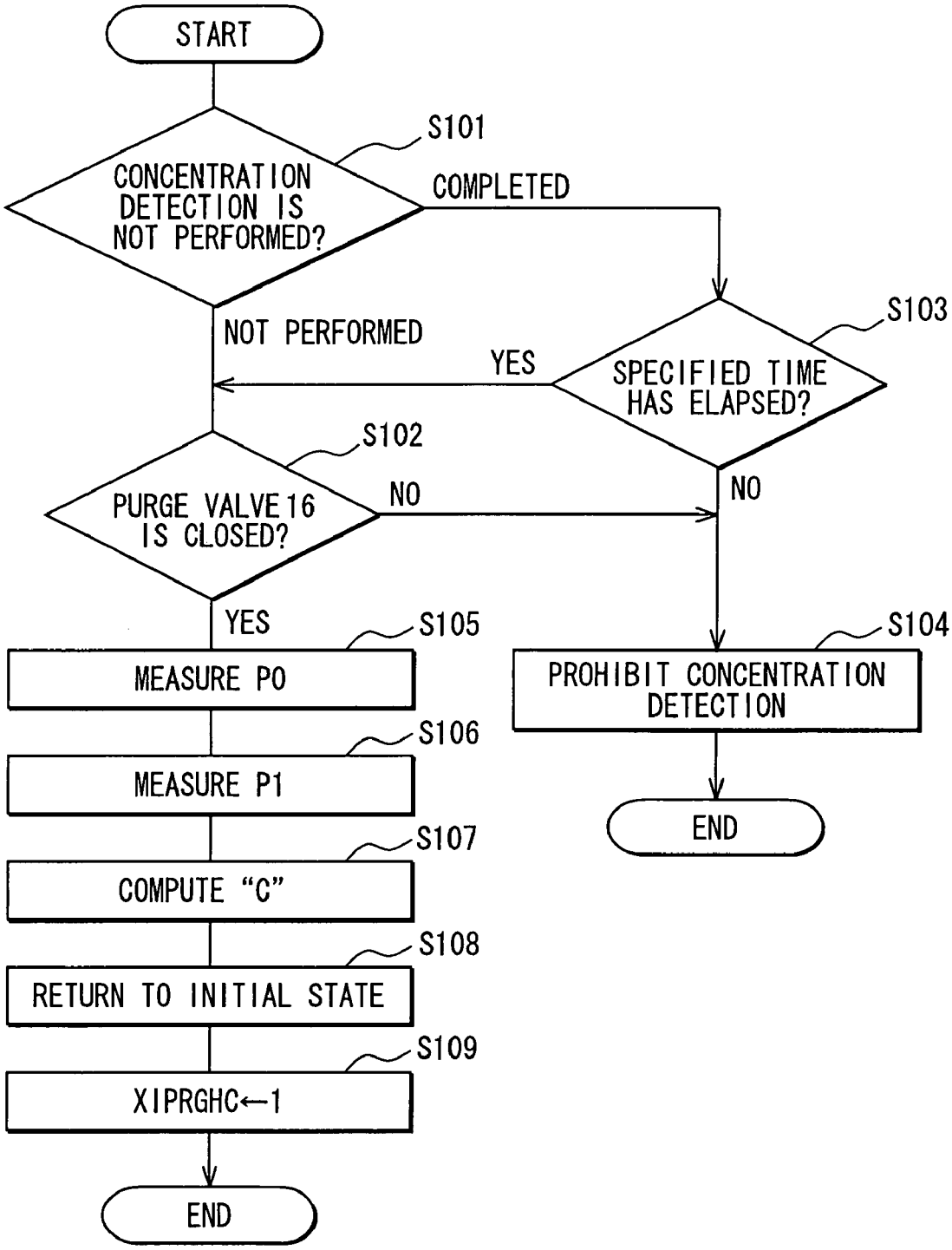
FIG. 4 is a flow chart of a concentration detection routine.

The control processing of the ECU 30 of this embodiment will be described below in detail. FIG. 4 is a flow chart showing a concentration detection routine for detecting a fuel concentration (fuel state) in purge gas purged from the canister 13. This routine is executed when interruptions are caused at specified intervals by the ECU 30.

In step S101 shown in FIG. 4, it is determined whether concentration detection is not yet performed, that is, whether a concentration detection completion flag XIPRGHC is "0" (concentration detection is not yet performed). When this determination is negative, that is, the concentration detection completion flag XIPRGHC is "1" (concentration detection is completed), the processing proceeds to step S103. When this determination is affirmative, the processing proceeds to step S102.

It is determined in step S102 whether the purge valve 16 is "closed". When determination in step S102 is negative, that is, the purge valve 16 is "opened", the concentration detection based on pressure measurement is prohibited in step S104 and this routine is finished. On the other hand, when the determination in step S102 is affirmative, the start of the concentration detection based on pressure measurement is determined and the processing proceeds to step S105.

It is determined in step S103 whether a specified time elapses from when the concentration detection based on the last pressure measurement is completed. When determination in step S103 is negative, the foregoing processing in step S104 is performed, and when the determination in step S103 is affirmative, the processing proceeds to step S102.

In step S105, pressure P0 is measured by the pressure sensor 24 in a state in which air flows as a gas flow in the measurement line 22. This state corresponds to "the first measurement state". Before the processing of step S105 is executed, the purge valve 16 is closed and the selector valve 18 is set to the first position in which the canister 13 is made to communicate with the atmosphere line 17 and the three-position valve 21 is set to the first position in which the air supply line 20 is connected to the measurement line 22. For this reason, pressure detected by the pressure sensor 24 in an initial state is nearly equal to the atmospheric pressure.

The pressure P0 of the air flow in this step S105 is measured by driving the pump 26 with the three-position valve 21 held set to the first position. In this case, air is supplied to the measurement line 22 via the air supply line 20. Pressure in an upstream position from the restrictor 23 of the air supply line 20 is equal to pressure in one end of the pressure sensor 24 and the other end of the pressure sensor 24 is connected to a downstream position from the restrictor 23 of the air supply line 20, so a pressure drop when the air flows through the restrictor 23 is detected by the pressure sensor 24.

In step S106, pressure P1 is measured in a state in which an air-fuel mixture containing the fuel vapor flows as a gas glow in the measurement line 22. This state corresponds to "the second measurement state". The pressure P1 of the air-fuel mixture is measured by driving the pump 26 while the three-position 21 is being switched to the third position.

In this case, the air-fuel mixture containing the fuel vapor is supplied to the measurement line 22, the air-fuel mixture being supplied via the atmosphere line 17, the canister 13, a portion of the purge line 15 to the branch line 19, and the branch line 19. That is, the air introduced from the atmosphere line 17 flows in the canister 13 to produce the air-fuel mixture of the fuel vapor and the air, and the air-fuel mixture is supplied to the measurement line 22 via the portion of the purge line 15 and the branch line 19. Thus, when the pressure of the air-fuel mixture is measured, a pressure drop when the air-fuel mixture containing the fuel vapor passes through the restrictor 23 of the measurement line 22 is detected by the pressure sensor 24.

In step S107, a fuel concentration C is computed on the basis of the pressure P0 measured in step S105 and the pressure P1 measured in step S106 and is stored. In the computation of the fuel concentration C, a pressure ratio RP between the pressures P0 and P1 is computed according to an equation 1 and the fuel concentration C is computed according to an equation 2 on the basis of the pressure ratio RP. In the equation 2, k1 is a constant determined appropriately in advance by experiment or the like.

$$RP=P1/P0 \quad \text{(Equation 1)}$$

$$C=k1\times(RP-1)(=(P1-P0)/P0) \quad \text{(Equation 2)}$$

Since the fuel vapor is heavier than the air, when the purge gas contains the fuel vapor, the density of the purge gas becomes high. When the number of revolutions of the pump 26 is the same and the velocity of flow (flow rate) of the purge gas in the measurement line 22 is the same, by the law of energy conservation, as the density of the purge gas is higher, the differential pressure between both sides of the restrictor 23 becomes larger. Thus, as the fuel concentration C becomes larger, the pressure ratio RP becomes larger and the relationship between the fuel concentration C and the pressure ratio RP becomes a linear relationship as shown by the equation 2. The fuel concentration C computed in this manner expresses the concentration of the fuel vapor in the purge gas by a mass ratio.

In step S108, the respective parts are returned to the initial states. That is, the selector valve 18 is returned to the first position in which the canister 13 is made to communicate with the atmosphere line 17 and the three-position valve 21 is returned to the first position in which the air supply line 20 is connected to the measurement line 22. In step S109, the concentration detection completion flag XIPRGHC is set to "1" and then this routine is finished.

Figure 5:
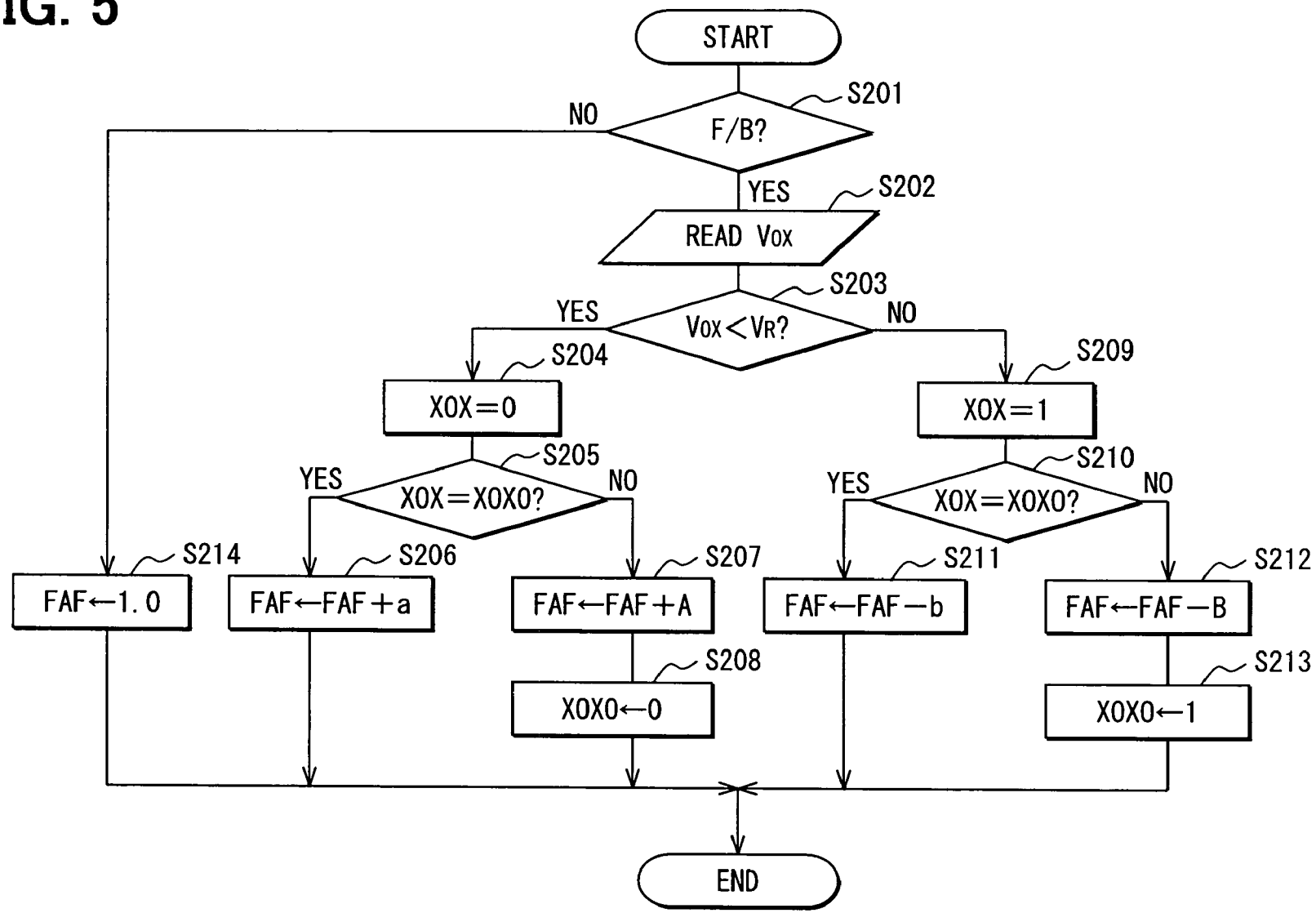
FIG. 5 is a flow chart of an air-fuel ratio F/B control routine.

FIG. 5 is a flow chart of an air-fuel ratio feedback (F/B) control routine. This routine is executed by the ECU 30 at intervals of a specified cam angle. In this routine, an output voltage is inputted from the air-fuel ratio sensor 6 and it is determined whether the air-fuel mixture is in a rich state or in a lean state. When the air-fuel mixture is changed from the rich state to the lean state and when the air-fuel mixture is changed from the lean state to the rich state, an air-fuel ratio correction factor FAF is changed (skipped) stepwise to increase or decrease a fuel injection quantity. When the air-fuel mixture is in the rich state or in the lean state, the air-fuel ratio correction factor FAF is gradually increased or decreased.

In step S201 shown in FIG. 5, it is determined whether air-fuel ratio feedback control is allowed. That is, when all of the following conditions (F/B conditions) are satisfied, the air-fuel ratio feedback control is allowed, and when any one of the F/B conditions is not satisfied, the air-fuel ratio feedback control is not allowed:

(1) it is not at the time of starting engine;

(2) fuel is not being cut;

(3) cooling water temperature (THW)≧0° C.; and (4) air-fuel ratio sensor 6 is active.

When determination in step S201 is affirmative, the processing proceeds to step S202. In step S202, the output voltage $V_{ox}$ of the air-fuel ratio sensor 6 is read. In step S203, it is determined whether the output voltage $V_{ox}$ is not larger than a specified reference voltage $V_R$ (for example, 0.45 V). When determination in step S203 is affirmative, the air-fuel ratio of the exhaust gas is lean and the processing proceeds to step S204 where an air-fuel ratio flag XOX is set to "0".

Next, it is determined in step S205 whether the air-fuel ratio flag XOX coincides with a state holding flag XOXO. When determination in step S205 is affirmative, it is determined that the lean state continues and the air-fuel ratio correction factor FAF is increased by a lean integrated quantity "a" in step S206. Then, this routine is finished. On the other hand, when determination in step S205 is negative, it is determined that the rich state is changed to the lean state and the air-fuel ratio correction factor FAF is increased by a lean skip quantity "A" in step S207. In this regard, the lean skip quantity "A" is set to a sufficiently large value as compared with the lean integrated quantity "a". Then, the state holding flag XOXO is reset in step S208 and this routine is finished.

When determination in step S203 is negative, it is determined that the air-fuel ratio of the exhaust gas is rich, and the processing proceeds to step S209 where the air-fuel ratio flag XOX is set to "1". Then, it is determined in step 210 whether the air-fuel ratio flag XOX coincides with the state holding flag XOXO. When determination in step S210 is affirmative, it is determined that the rich state continues and the air-fuel ratio correction factor FAF is decreased by a rich integrated quantity "b" in step S211. Then, this routine is finished. On the other hand, when determination in step S210 is negative, it is determined that the lean state is changed to the rich state and the processing proceeds to step S212 where the air-fuel ratio correction factor FAF is decreased by a rich skip quantity "B". In this regard, the rich skip quantity "B" is set to a sufficiently larger value as compared with the rich integrated quantity "b".

In step S213, the state holding flag XOXO is set to "1" and this routine is finished. When determination in step S201 is negative, the processing proceeds to step S214 where the air-fuel ratio correction factor FAF is set to "1.0". Then, this routine is finished.

Figure 6:
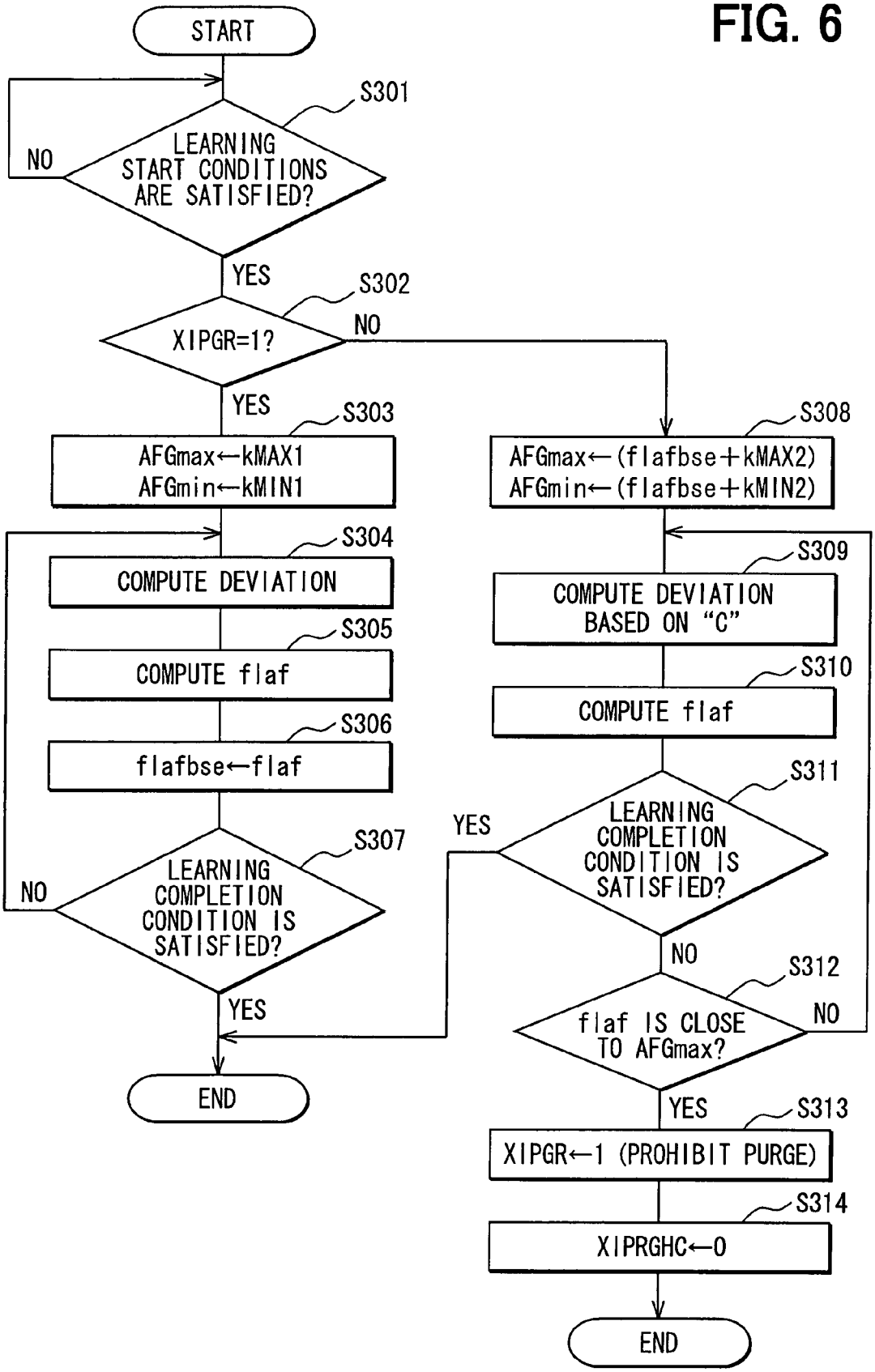
FIG. 6 is a flow chart of an air-fuel ratio learning routine.

FIG. 6 is a flow chart showing a routine for learning an air-fuel ratio as a base routine executed by the ECU 30. In step S301 shown in FIG. 6, it is determined whether air-fuel ratio learning start conditions are satisfied. These air-fuel ratio learning start conditions include the F/B conditions, the cooling water temperature condition (THW>80° C.), and the concentration detection completion condition (concentration detection completion flag XIPRGHC=1), which have been described above.

When determination in step S301 is affirmative, the processing proceeds to step S302. When determination in step S301 is negative, the processing becomes a standby state until the air-fuel ratio learning start conditions are satisfied. When the air-fuel ratio learning start conditions are satisfied, it is determined in step S302 whether a purge stop flag XIPGR is "1" (purge is not yet performed). When determination in step S302 is affirmative, processing in step S303 and subsequent steps is performed. When determination in step S302 is negative, processing in step S308 and subsequent steps is performed.

In step S303, learning guard values (upper limit AFGmax and lower limit AFGmin) for a learning correction value flaf to be described later are set as shown by an equation 3 and an equation 4. Here, the values of kMAX1 and kMIN1 in the equation 3 and the equation 4 are previously set.

$$AFGmax=kMAX1 \quad \text{(Equation 3)}$$

$$AFGmin=kMIN1 \quad \text{(Equation 4)}$$

In step S304, an air-fuel ratio deviation between an air-fuel ratio detected by the air-fuel sensor 6 and a target air-fuel ratio (stoichiometric air-fuel ratio) is computed. In step S305, the learning correction value flaf for correcting the air-fuel ratio deviation computed in step S304 is computed and is stored in the RAM (not shown) of the ECU 30.

In step S306, to use the learning correction value flaf when purge is not yet performed, which is computed in step S305, for setting a learning guard value when purge is being performed (in step S308 to be described later), the learning correction value flaf is set to a learning guard base value flafbse.

It is determined in step S307 whether air-fuel ratio learning completion condition is satisfied. The air-fuel ratio learning completion condition means that a predetermined number of skips of the air-fuel ratio correction factor FAF are completed in a state in which a deviation (ΔFAF) of the air-fuel ratio correction factor FAF is within 2%, the deviation (ΔFAF) showing an absolute value of a difference (|FAF−1|) between the air-fuel ratio correction factor FAF and the reference value (=1) of the air-fuel ratio correction factor. When determination in step S307 is negative, the processing proceeds to step S304 where air-fuel ratio learning is repeatedly performed. On the other hand, when determination in step S307 is affirmative, this routine is finished.

When it is determined in step S302 that purge is being performed, processing in step S308 and subsequent steps is performed. In step S308, learning guard values (upper limit AFGmax and lower limit AFGmin) for the learning correction value flaf when purge is being performed are set as shown by an equation 5 and an equation 6 with reference to the learning guard base value flafbse set in step S306 (=the learning correction value (flaf) when purge is not yet performed). Here, the values of kMAX2 and kMIN2 in the equation 5 and the equation 6 are previously set.

$$AFGmax=flafbse+kMAX2 \quad \text{(Equation 5)}$$

$$AFGmin=flafbse+kMIN2 \quad \text{(Equation 6)}$$

In step S309, an air-fuel ratio deviation between the air-fuel ratio detected by the air-fuel ratio sensor 6 and the target air-fuel ratio is computed by the use of the fuel concentration C in the purge gas found in the concentration detection routine. Here, the air-fuel ratio detected by the air-fuel ratio sensor 6 shows a weight ratio between fuel and air that are sucked into the cylinder in the intake stroke of the engine 1. When a fuel concentration C showing the concentration of the fuel vapor in the purge gas by a weight ratio is detected when purge is not yet performed, even if purge is performed thereafter, it is possible to discriminate whether the air-fuel ratio deviation between the air-fuel ratio detected by the air-fuel ratio sensor 6 and the target air-fuel ratio is caused by the purge or a factor other than the purge (for example, the individual difference of the injector 4).

Here, in step S309, the fuel concentration C is subtracted from the air-fuel ratio detected by the air-fuel ratio sensor 6 and the air-fuel ratio deviation between the subtraction result and the target air-fuel ratio is computed. With this, the purge can be performed while the air-fuel ratio learning is being performed without temporarily stopping the air-fuel ratio learning, like the related art described above (in other words, the air-fuel ration learning and the purge can be performed at the same time).

In step S310, the learning correction value flaf for correcting the air-fuel ratio deviation computed in step S309 is computed and stored in the RAM of the ECU 30.

It is determined in step S311 whether the foregoing air-fuel ratio learning conditions are satisfied. When determination in step S311 is affirmative, this routine is finished. On the other hand, when determination in step S311 is negative, the processing proceeds to step 312.

In step S312, it is determined whether the learning correction value flaf computed in step S310 is close to the learning guard value (upper limit value AFGmax or lower limit value AFGmin) set in step S308 or tends to get close to the learning guard value (for example, the learning correction value flafg is getting close to a specified value or less from the upper limit value AFGmax or the lower limit value AFGmin).

When determination in step S312 is affirmative, the processing proceeds to step 313. When determination in step S312 is negative, the processing proceeds to step 309 and the foregoing processing is repeatedly performed.

In this manner, the processing from step S308 to step 312 sets the learning guard values (upper limit value AFGmax and lower limit value AFGmin) for the learning correction value when purge is being performed by the use of the learning guard base value flafbse (=learning correction value flaf when purge is not yet performed) set in step S306 and learns the air-fuel ratio by the use of the set learning guard values. This is because of the following reason.

For example, when the purge line 15 cracks or the pressure sensor 24 fails temporarily, the fuel concentration C is erroneously detected in the foregoing concentration detection routine. In this air-fuel ratio learning routine, when purge is being performed, the air-fuel ratio is learned by the use of the fuel concentration C detected in the concentration detection routine. Therefore, the air-fuel ratio is erroneously learned because the fuel concentration C is erroneously detected.

Hence, when purge is being performed, not to erroneously learn the air-fuel ratio by a large amount in this air-fuel ratio learning routine, the learning guard values are set on the basis of the learning correction value when purge is not yet performed and the air-fuel ratio is learned by the use of these learning guard values set in this manner. With this, the effect of detection accuracy of the fuel concentration C by the concentration detection routine can be reduced.

When determination in step S312 is affirmative, that is, when the learning correction value flaf computed in step S310 is close to or tends to get close to the upper limit value AFGmax or the lower limit value AFGmin, the purge stop flag XIPGR is set to "1" in step S313 to prohibit performing purge. With this, when purge is being performed in a purge performing routine, which will be described later, the purge is stopped. In step S314, the concentration detection completion flag XIPRGHC is set to "0" (not yet performed) and then this routine is finished. With this, the foregoing concentration detection routine is started, so the fuel concentration C when the purge is stopped is again detected.

This is because of the following reason: when the learning correction value flaf is close to or tends to get close to the learning guard values (upper limit value AFGmax or lower limit value AFGmin) in step S312, it can be thought that the fuel concentration C and the learning correction value flaf show abnormal values, so performing purge is prohibited and the fuel concentration C is again detected and the fuel concentration C and the learning correction value flaf are reset, and then the air-fuel ratio is again learned; when the air-fuel ratio is again learned, controllability of a specified level can be always secured.

Figure 7:
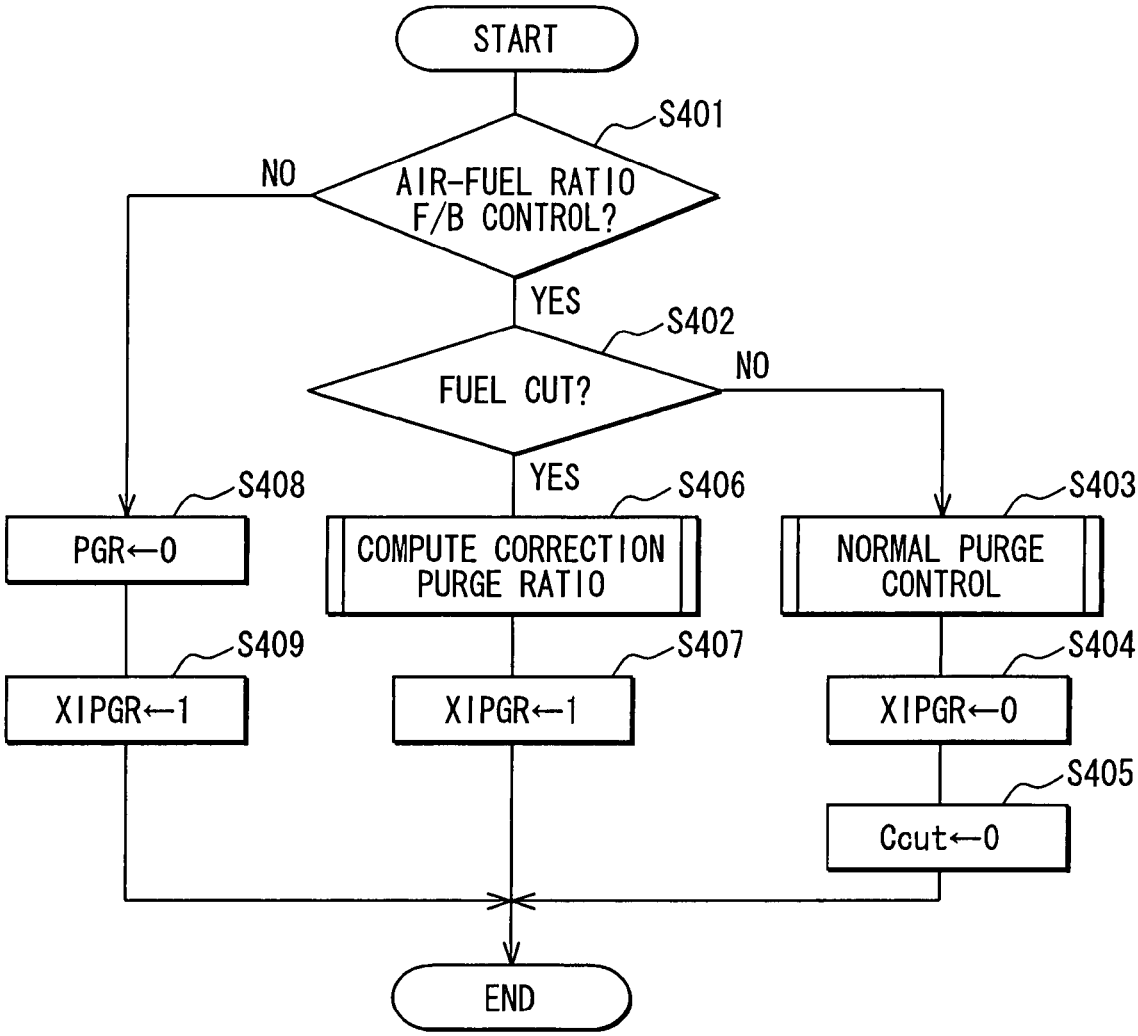
FIG. 7 is a flow chart of a purge performing routine.

FIG. 7 is a flow chart of the purge performing routine. This routine is executed in parallel to the foregoing air-fuel ratio F/B control routine. In step S401, it is determined whether air-fuel ratio feedback control is being performed. When determination in step S401 is affirmative, the processing proceeds to step S402 where fuel is being cut.

When determination in step S402 is negative, the processing proceeds to step S403 where normal purge ratio control is performed and then the processing proceeds to step S404. In step S404, the purge stop flag XIPGR is reset (set to "0") and then in step S405 a fuel cut counter Ccut is reset and then this routine is finished. On the other hand, when determination in step S402 is affirmative, the processing proceeds to step S406 where a correction purge ratio at restart timing is computed and then in step S407 the purge stop flag XIPGR is set to "1" and then this routine is finished.

Moreover, when determination in step S401 is negative, the processing proceeds to step S408 where a purge ratio PGR is reset (set to "0") and then in step S409 the purge stop flag XIPGR is set to "1" and then this routine is finished.

Figure 8:
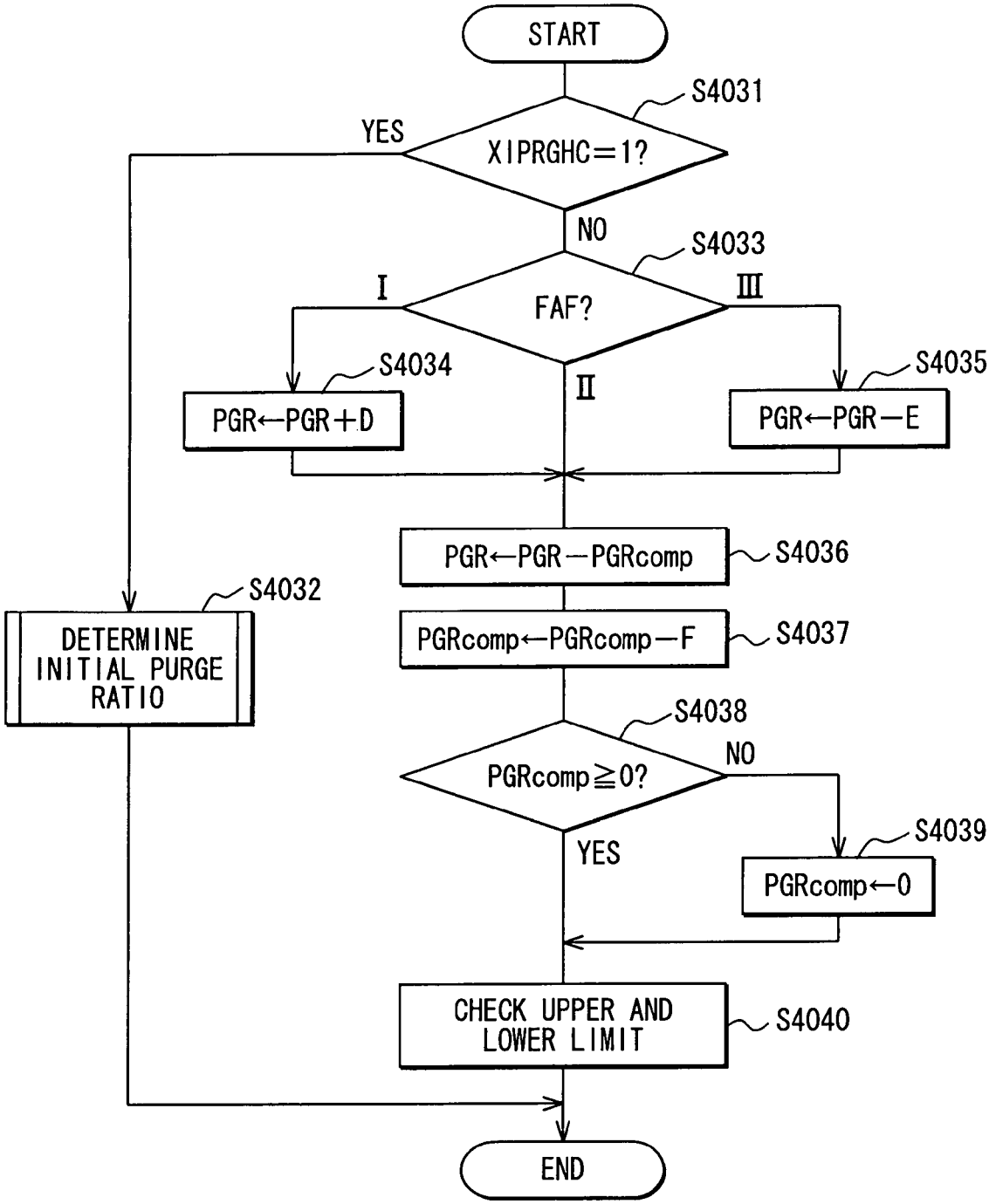
FIG. 8 is a flow chart of a normal purge ratio control processing.

FIG. 8 is a flow chart of normal purge ratio control processing performed in step S403 of the purge performing routine, shown in FIG. 7. First, in step S4031, it is determined whether the concentration detection completion flag XIPGHC is 1. When determination in step S4031 is affirmative, an initial purge ratio determination routine is performed in step S4032.

Figure 9:
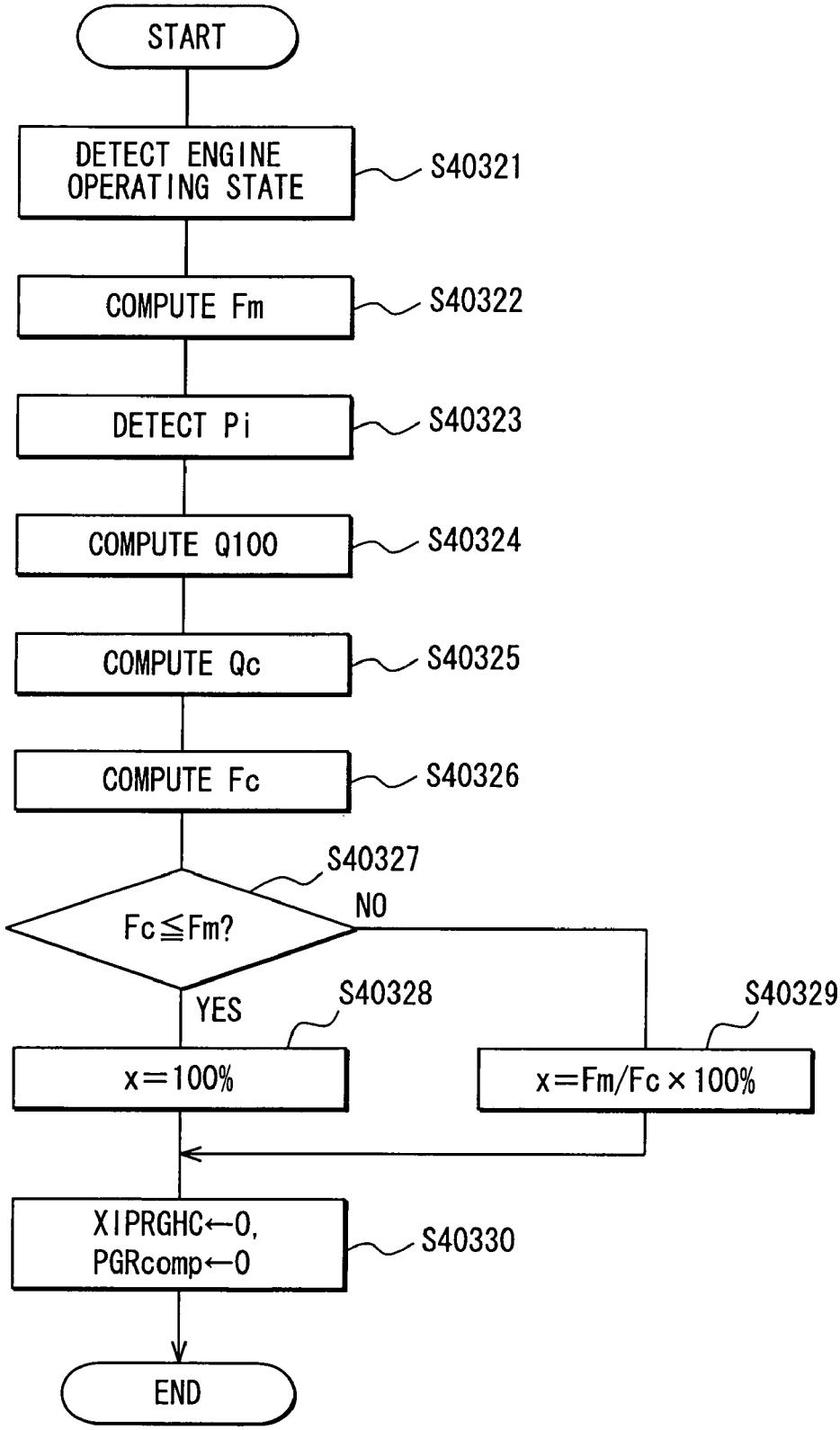
FIG. 9 is a flow chart of an initial purge ratio determination routine.

The initial purge ratio determination routine is shown in detail in FIG. 9. First, an upper allowable limit value of purge flow rate is set in steps S40321 and S40322. That is, the operating state of the engine 1 is detected in step S4031 and an allowable value Fm to be allowed for purge fuel vapor flow rate is computed on the basis of the detected operating state in step S40322. The allowable value Fm for purge fuel vapor flow rate is computed on the basis of the fuel injection quantity required in the operating state of the engine 1 such as the present opening of the throttle and the lower limit value of the fuel injection quantity to be controlled by the injector 4. When the fuel injection quantity is large, the ratio of the purge fuel vapor flow rate to the fuel injection quantity becomes small and hence the allowable value Fm for purge fuel vapor flow rate can be allowed to a large value.

Figure 10:
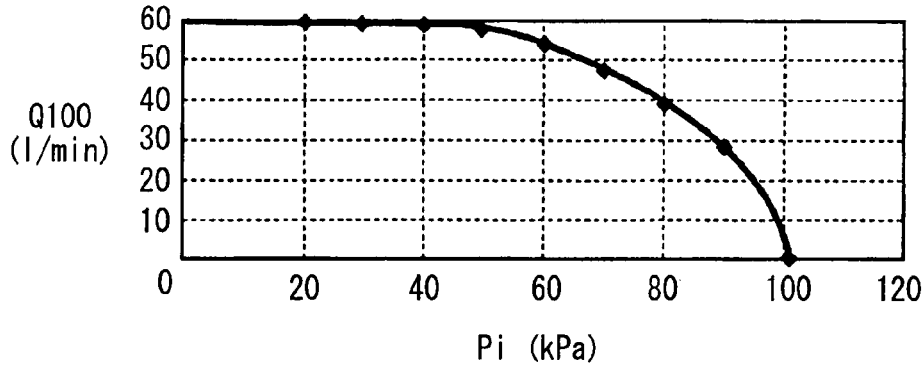
FIG. 10 is a diagram to show an example of a base flow rate map.

In step S40323, present intake pipe pressure Pi is detected by the intake air pressure sensor (not shown) and in step S40324, a reference flow rate Q100 is computed on the basis the intake pipe pressure Pi. The reference flow rate Q100 is the flow rate of gas flowing in the purge line 15 when the gas is 100% of air and the opening of the purge valve 16 (hereinafter, as appropriate, referred to as "purge valve opening") is 100%. The reference flow rate Q100 is computed according to a reference flow rate map. One example of the reference flow rate map is shown in FIG. 10.

Figure 11:
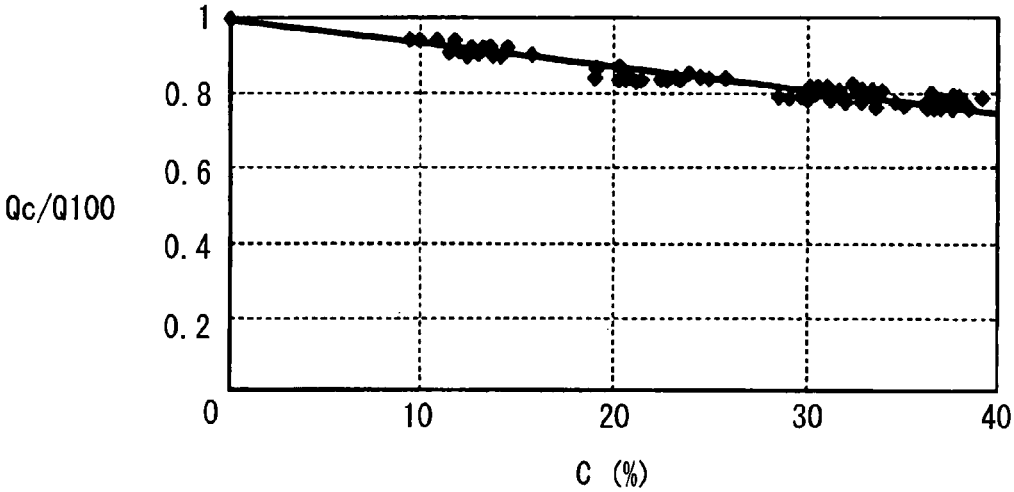
FIG. 11 is a diagram to show a relationship between fuel concentration C and ratio (Qc/Q100) of estimated flow rate Qc.

In step S40325, the estimated flow rate Qc of purge air-fuel mixture is computed on the basis of the fuel concentration C detected by the concentration detection routing according to an equation 7. The estimated flow rate Qc is the estimated value of purge gas flow rate when purge gas of a present fuel concentration C is flowed in the purge line 15 with the purge valve opening set to 100%. FIG. 11 shows a relationship between the fuel concentration C and the ratio (Qc/Q100) of the estimated flow rate Qc to the reference flow rate Q100. As the fuel concentration C becomes larger, the density of purge gas becomes larger. Thus, even if the intake pipe pressure Pi is the same, by the law of energy conservation, flow rate becomes smaller as compared with a case in which purge gas is 100% of air. A straight line shown in the drawing is equivalent to the equation 7. In the equation 7, A is a constant and is previously stored in the ROM (not shown) of the ECU 30 along with the control program.

$$Qc=Q100\times(1-A\times C) \quad \text{(Equation 7)}$$

In step S40326, the estimated flow rate of purge fuel vapor (hereinafter, as appropriate, referred to as "estimated purge fuel vapor flow rate") Fc when purge gas of the present fuel concentration C is flowed in the purge line 15 with the opening of the purge valve set to 100% is computed on the basis of the fuel concentration C and the estimated flow rate Qc according to an equation 8.

$$Fc=Qc\times C \quad \text{(Equation 8)}$$

A purge valve opening X is set in steps S40327 to S40329. In step S40327, the estimated purge fuel vapor flow rate Fc is compared with the allowable value Fm for purge fuel vapor flow rate and it is determined whether Fc≦Fm. When determination in step S40327 is affirmative, the processing proceeds to step S40328 where the purge valve opening X is set to 100%. This is because even if the purge valve opening X is set to 100%, there is an allowance for the allowable value Fm for purge fuel vapor flow rate. When determination is step S40327 where it is determined whether Fc≦Fm is negative, it is determined that when the purge valve opening X is 100%, the air-fuel ratio control cannot be performed normally because of the excessive fuel vapor, and the processing proceeds to step S40329 where the purge valve opening X is set to (Fm/Fc)×100%. This is because when Fc>Fm, the maximum purge flow rate in which proper air-fuel ratio control is guaranteed becomes the allowable value Fm for purge fuel vapor flow rate.

When the purge valve opening X is computed in steps S40328 and S40329, the purge valve 16 is controlled to the purge valve opening X. Then, after executing processing in steps S40328 and S40329, in step S40330, the concentration detection completion flag XIPRGHC is reset (to "0") and a correction purge ratio at restart timing PRGcomp is set to "0". Since the concentration detection completion flag XIPRGHC is reset in step S40330, thereafter, determination in step S4031 shown in FIG. 8 becomes negative and hence processing of step S4033 and subsequent steps is executed.

Figure 12:
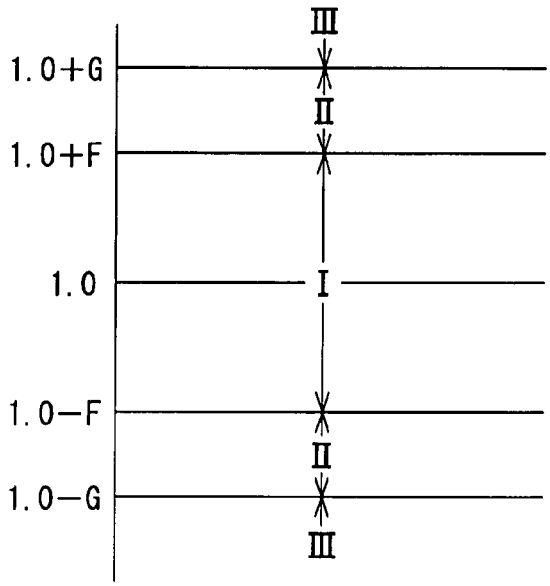
FIG. 12 is a graph to show domains of an air-fuel ratio correction factor FAF.

In step S4033 shown in FIG. 8, it is determined which domain the air-fuel ratio correction factor FAF belongs to. FIG. 12 is a graph showing the domain of the air-fuel ratio correction factor FAF. It is determined that: when the air-fuel ratio correction factor FAF is within 1±F, the FAF belongs to a domain I; when the air-fuel ratio correction factor FAF is between 1+F and 1+G or between 1−F and 1−G, the FAF belongs to a domain II; and when the air-fuel ratio correction factor FAF is outside 1±G, the FAF belongs to a domain III, where 0<F<G.

When it is determined in step S4033 that the air-fuel ratio correction factor FAF belongs to the domain I, the processing proceeds to step S4034 where the purge ratio PGR is increased by a predetermined purge ratio up quantity D and then processing proceeds to step S4036. When it is determined in step S4033 that the air-fuel ratio correction factor FAF belongs to the domain III, the processing proceeds to step S4035 where the purge ratio PGR is decreased by a predetermined purge ratio down quantity E and then processing proceeds to step S4036. When it is determined in step S4033 that the air-fuel ratio correction factor FAF belongs to the domain II, the processing directly proceeds to step S4036.

In step S4036, a correction purge ratio at restart timing PGRcomp, which will be described later, is subtracted from the purge ratio PGR and then processing proceeds to step S4037. In step S4037, a predetermined value F is subtracted from the correction purge ratio at restart timing PGRcomp and in step S4038, it is determined whether the correction purge ratio at restart timing PGRcomp is positive.

When determination in step S4038 is negative, the correction purge ratio at restart timing PGRcomp is set to a lower limit "0" in step S4039 and the processing proceeds to step S4040. When determination in step S4038 is affirmative, the processing proceeds directly to step S4040. In step S4040, the upper and lower limit values of the purge ratio PGR are checked and this routine is finished.

Figure 13:
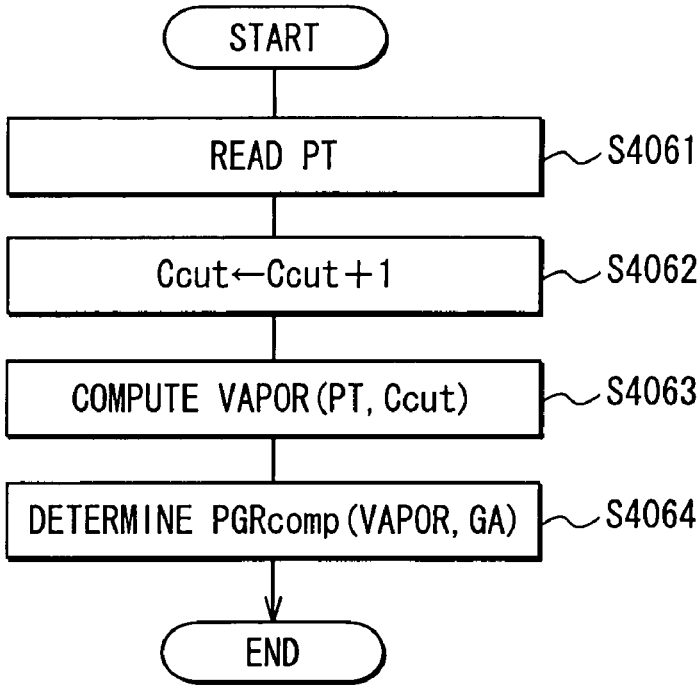
FIG. 13 is a flow chart of computing a correction purge ratio at restart timing.

FIG. 13 is a flow chart for computing a correction purge ratio at restart timing PGRcomp, which is executed in step S406 of the purge performing routine, shown in FIG. 7. First, in step S4061, a fuel tank pressure PT is detected by a pressure sensor (not shown) disposed in the fuel tank 11. The fuel tank pressure PT is the function of an evaporated fuel quantity in the fuel tank 11. The evaporated fuel quantity in the fuel tank 11 expresses the state of equilibrium between the evaporation of the fuel, the discharge of the fuel into the canister 13, and the liquefaction of the evaporated fuel, so the fuel tank pressure PT expresses the degree of evaporation of the fuel in the fuel tank 11. The degree of evaporation of the fuel is almost determined by a fuel temperature and pressure applied to the surface of the fuel, so the degree of evaporation of the fuel may be expressed by the fuel temperature in place of the fuel tank pressure PT. However, when the fuel tank pressure PT is used as a parameter, the effect of a change in the atmospheric pressure is cancelled, so the degree of evaporation of the fuel can be detected more accurately with ease.

In the next step S4062, the fuel cut counter Ccut is incremented and the processing proceeds to step S4063. The fuel cut counter Ccut expresses the time during which a fuel cut state continues. In step S4063, an evaporated fuel quantity VAPOR (PTC, cut) adsorbed by the adsorbent material 14 in the canister 13 during the fuel cut is found as the function of the fuel tank pressure PT and the fuel cut counter Ccut.

As a function for finding the evaporated fuel quantity VAPOR can be used, for example, the following function. That is, a fuel evaporation quantity per unit time α(PT) can be determined as a function of the fuel tank pressure PT, so the evaporated fuel quantity VAPOR can be found by an equation 9 of multiplying the fuel evaporation quantity per unit time α(PT) by the count value of the fuel cut counter Ccut corresponding to an elapsed time.

$$\text{VAPOR}=\alpha(PT)\times Ccut \quad \text{(Equation 9)}$$

In step S4064, the correction purge ratio at restart timing PGRcomp, shown by an equation 10, is determined as a function of the evaporated fuel quantity VAPOR and an intake air quantity GA detected by the air flow sensor 31. Here, β in the equation 10 is a factor.

$$PGRcomp=\beta\times VAPOR/GA \quad \text{(Equation 10)}$$

Figure 14:
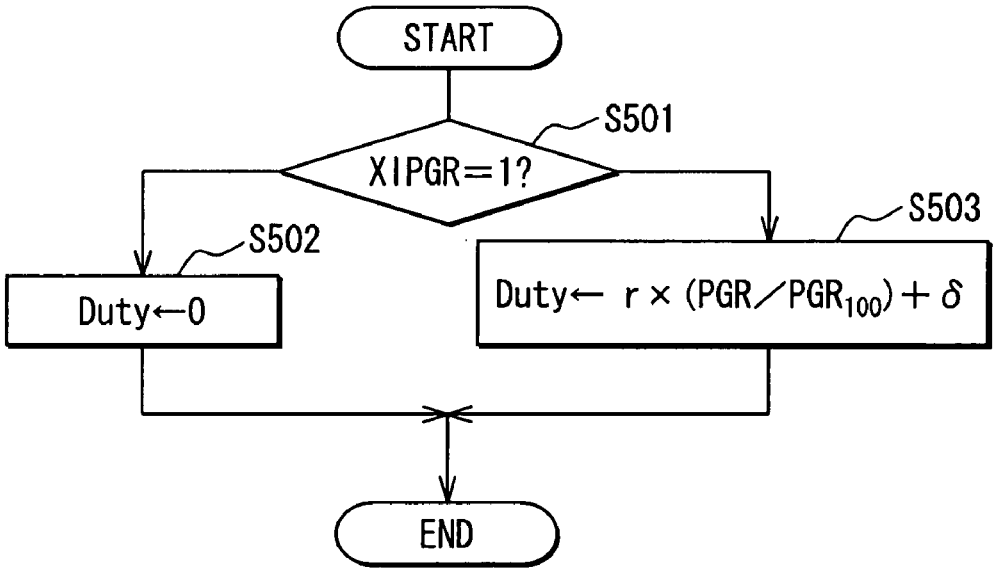
FIG. 14 is a flow chart of a purge control valve driving routine.

FIG. 14 is a flow chart of a routine for driving a purge control valve. According to the flow chart, the opening of the purge valve 16 is controlled by the so-called duty ratio control. That is, it is determined in step S501 whether the purge stop flag XIPGR is "1", When determination in step S501 is affirmative, it is determined that purge is not yet performed and in step S502 a duty ratio Duty is set to "0" and this routine is finished.

Figures 15, 17:
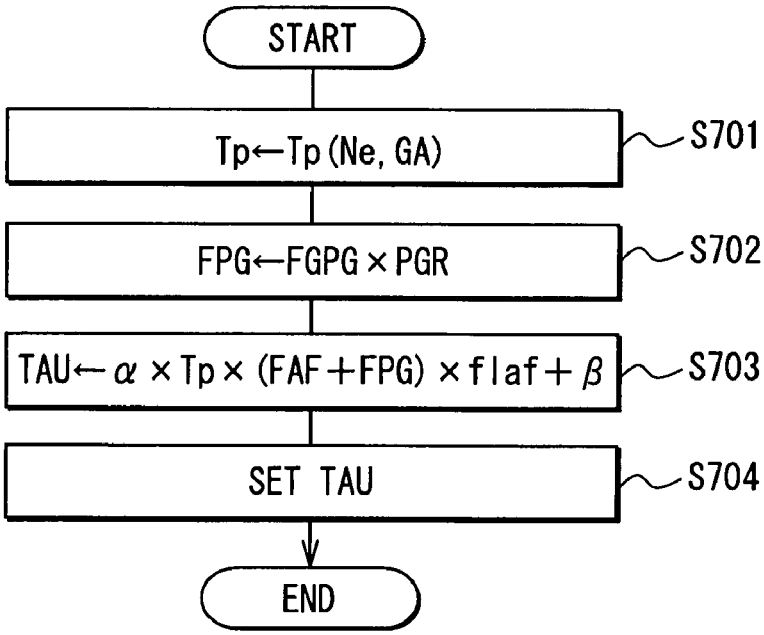
FIG. 15 shows an example of a map for determining a full-open purge ratio.
FIG. 17 is a flow chart of an injector control routine.

On the other hand, when determination in step S501 is negative, to perform purge, the processing proceeds to step S503 where the duty ratio Duty is computed on the basis of an equation 11.

$$Duty=\gamma\times PGR/PGR_{100}+\delta \quad \text{(Equation 11)}$$

where $PGR_{100}$ is a full-open purge ratio which expresses a purge quantity when the purge valve 16 is fully opened. The full-open purge ratio is previously set as a map of an engine rotation speed Ne and a throttle valve opening TA. FIG. 15 is an example of a map for determining the full-open purge ratio. Here, $\gamma$ and $\delta$ are correction factors determined by a battery voltage and the atmospheric pressure.

Figure 16:
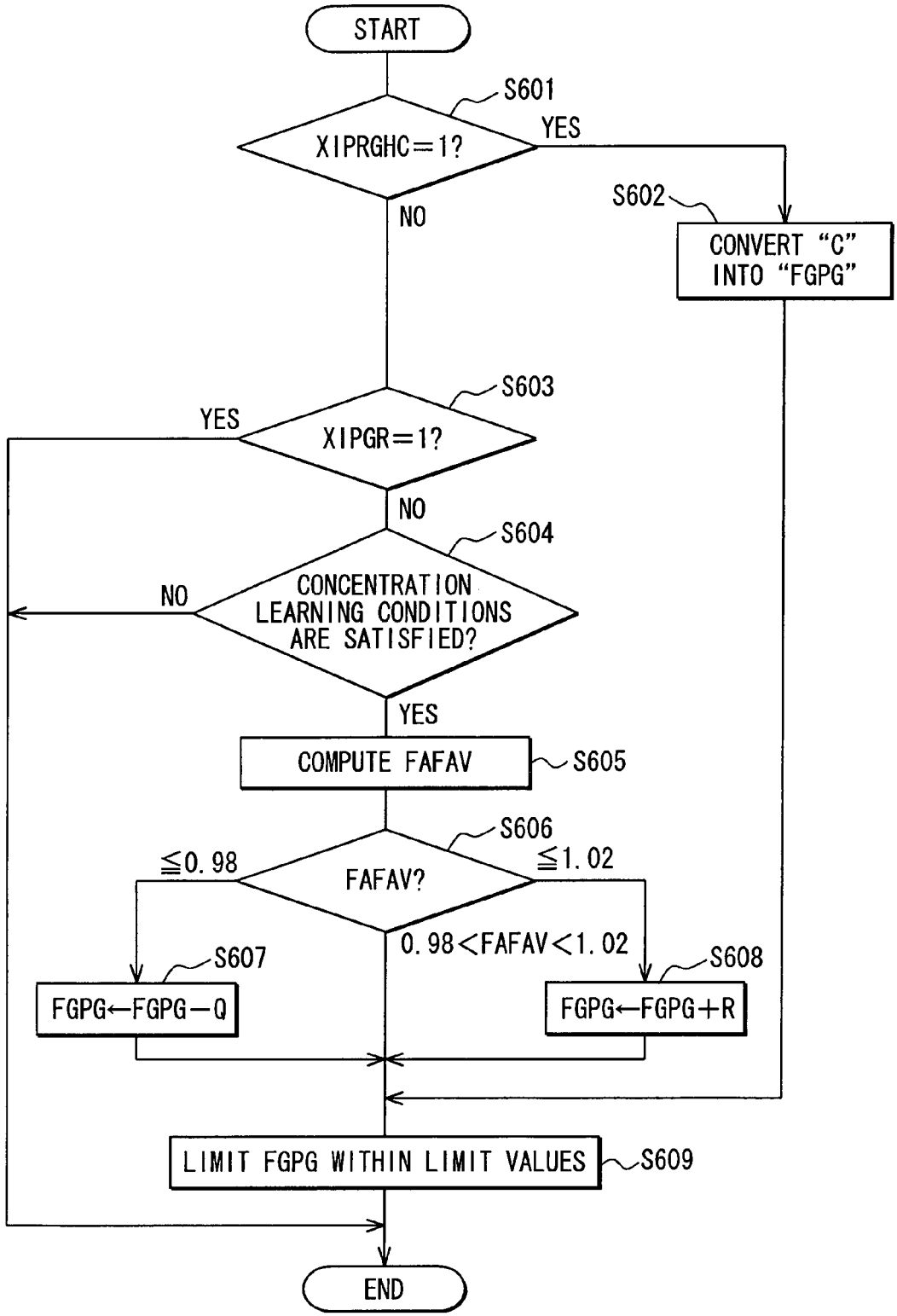
FIG. 16 is a flow chart of a fuel concentration learning routine.

FIG. 16 is a flow chart of a routine for learning a fuel concentration to compute a fuel concentration FGPG. It is determined in step S601 whether the concentration detection completion flag XIPRGHC is 1. When determination in step S601 is affirmative, step S602 is executed. In step S602, the fuel concentration C detected in FIG. 4 is substituted into an equation 12, thereby being converted to the fuel concentration FGPG compared with a stoichiometric air-fuel ratio (=14.6) of the target air-fuel ratio and expressing the relative fuel concentration of the purge gas. Here, as for the density of the fuel vapor and the density of the air in the equation 12, predetermined values may be used or they may be determined on the basis of temperature.

$$FGPG=(1-C)-(14.6\times C\times \text{density of fuel vapor/density of air}) \quad \text{(Equation 12)}$$

When the ratio of the fuel vapor in the purge gas is the same as that of the air-fuel mixture of a stoichiometric air-fuel ratio, the foregoing fuel concentration FGPG becomes 0. When the ratio of the fuel vapor in the purge gas is larger than the stoichiometric air-fuel ratio, the fuel concentration FGPG becomes minus. Moreover, when the ratio of the fuel vapor in the purge gas is smaller than the stoichiometric air-fuel ratio, the fuel concentration FGPG becomes plus. Furthermore, when the fuel vapor is not absolutely contained in the purge gas, the fuel concentration FGPG becomes 1. Thus, it can be said that the fuel concentration FGPG expresses the degree of a deviation in the air-fuel ratio of the purge gas from the stoichiometric air-fuel ratio. Then, the processing proceeds to step S609 to be described later.

When determination in step S601 is negative, the processing proceeds to step S603 where it is determined whether the purge stop flag XIPGR is "1". When determination in step S603 is affirmative, it is determined that purge is stopped and this routine is finished.

When determination in step S601 is affirmative, the processing proceeds to step S604 where it is determined whether concentration learning conditions are satisfied. That is, when all of the following conditions are satisfied, concentration learning is performed and when any one of the conditions is not satisfied, the concentration learning is not performed:

(1) air-fuel ratio feedback control is being performed;

(2) cooling water temperature (THW)≧80° C.;

(3) fuel increase quantity at startup=0; and (4) fuel increase quantity in idling=0.

When determination in step S604 is negative, that is, when the concentration learning is not performed, this routine is finished. When determination in step S604 is affirmative, that is, when the concentration learning is performed, the processing proceeds to step S605. In step S605, the time average value FAFAV of the air-fuel ratio correction factor FAF computed in the air-fuel ratio F/B control routine, shown in FIG. 5, is computed and the processing proceeds to step S606.

In step S606, it is determined which of a domain not larger than "0.98", a domain from "0.98" to "1.02", and a domain not smaller than "1.02" the average value FAFAV belongs to. When it is determined that the average value FAFAV is not larger than "0.98", the processing proceeds to step S607 where the fuel concentration FGPG is decreased by a specified quantity "Q" (for example, 0.4%) and the processing proceeds to step S609.

When it is determined in step S606 that the average value FAFAV is not smaller than "1.02", the processing proceeds to step S608 where the fuel concentration FGPG is increased by a specified quantity "P" (for example, 0.4%) and the processing proceeds to step S609. Moreover, when it is determined in step S606 that the average value FAFAV is more than "0.98" and smaller than "1.02", the processing proceeds to step S609 without updating the fuel concentration FGPG.

Here, if the fuel concentration of the purge gas is "0", the fuel concentration FGPG determined by executing step S607 or step S608 is set to "1". As the fuel concentration of the purge gas becomes larger, the fuel concentration FGPG becomes a value smaller than "1". In step S609, the fuel concentration FGPG is limited to a value within the upper and lower limit values and then this routine is finished.

FIG. 17 is a flow chart of an injector control routine. This routine is executed by interrupts at specified time intervals by the ECU 30. First, in step S701, as shown by an equation 13, a base fuel injection time Tp is found as a function of the engine rotation speed Ne and the intake air quantity GA.

$$Tp=Tp(Ne, GA) \quad \text{(Equation 13)}$$

In step S702, a purge correction factor FPG shown by an equation 14 is computed on the basis of the purge ratio PGR and the fuel concentration FGPG.

$$FPG=FGPG\times PGR \quad \text{(Equation 14)}$$

In step S703, an injector valve opening time TAU is determined by an equation 15 by the use of the air-fuel ratio correction factor FAF, a purge correction factor FPG, and the learning correction value flaf found in the air-fuel ratio learning routine shown in FIG. 6. Here, $\alpha$ and $\beta$ in the equation 15 are correction factors including an increase quantity in idling and an increase quantity at startup.

$$TAU=\alpha\times Tp\times(FAF+FPG)\times flaf+\beta \quad \text{(Equation 15)}$$

In step S704, the injector valve opening time TAU is outputted and then this routine is finished.

In this manner, in the air-fuel ratio control apparatus of this embodiment, even in the period during which purge is performed, the air-fuel ratio can be learned by the use of the fuel concentration C in the purge gas found by the concentration detection routine in the air-fuel ratio learning routine shown in FIG. 6. With this, purging gas can be performed while learning the air-fuel ratio without stopping learning the air-fuel ratio like the related art (in other words, learning the air-fuel ratio and purging gas can be performed at the same time).

A second embodiment of the present invention will be described below.

Figure 18:
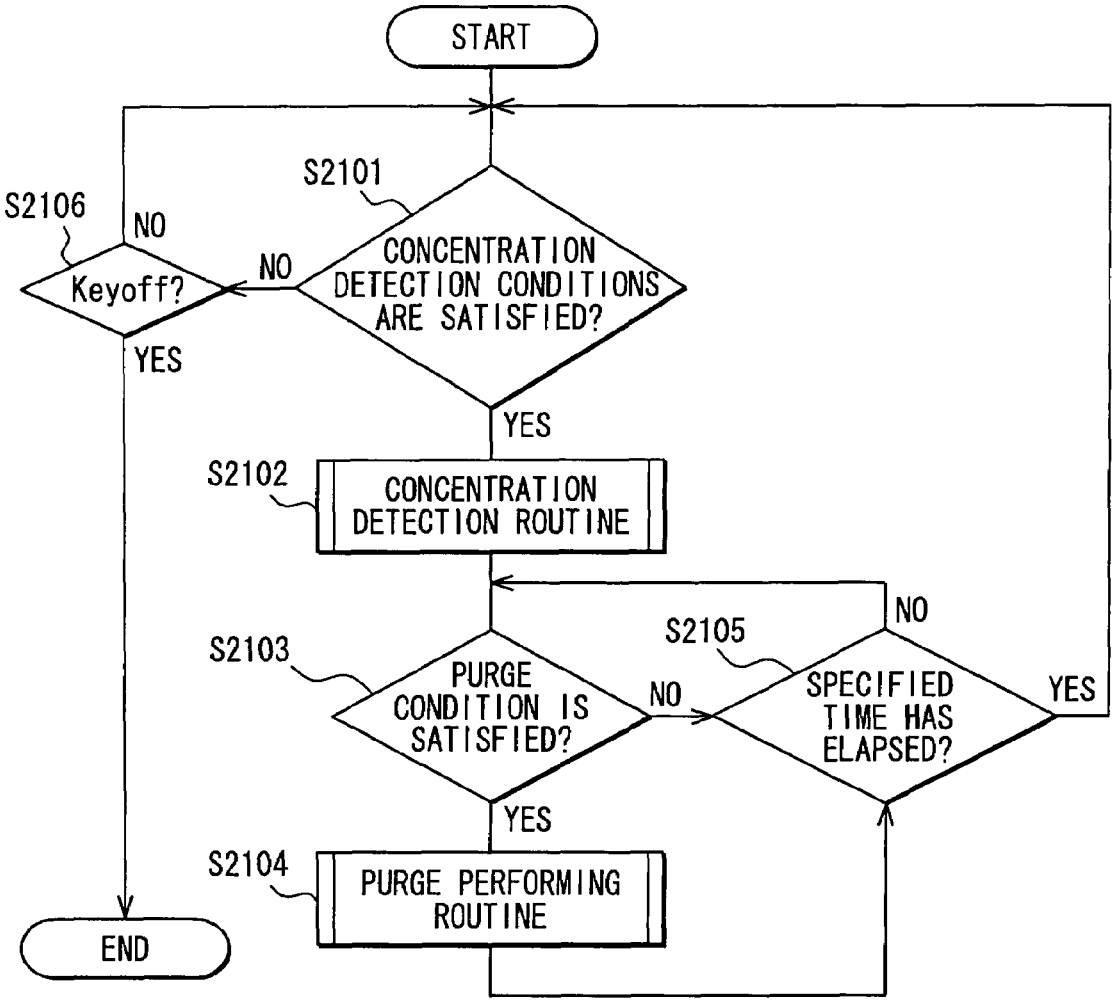
FIG. 18 is a flow chart of purging evaporated fuel, executed by an ECU 30.

FIG. 18 is a flow chart of purging the evaporated fuel, executed by the ECU 30. This flow chart is executed when the engine 1 starts operating. In step S2101, it is determined whether concentration detection conditions are satisfied. The concentration detection conditions are satisfied when state quantities showing the operating state such as engine water temperature, oil temperature, and engine rotation speed are within specified ranges. The concentration detection conditions are set so as to be satisfied earlier than the purge condition to be described later is satisfied, the purge condition determining whether the evaporated fuel is allowed to be purged.

The purge condition is that, for example, since the engine cooling water temperature becomes not lower than a specified value Temp1, it is determined that engine idling is completed. The concentration detection condition is satisfied while the engine is idling but it is necessary that, for example, the cooling water temperature is not lower than a specified value Temp2 that is set lower than the specified value Temp1. Moreover, the concentration detection conditions are satisfied also during a period in which the engine is being operated and in which purging the evaporated fuel is stopped (mainly, during deceleration). When this evaporated fuel processing apparatus is applied to a hybrid vehicle, the concentration detection condition is satisfied also when the vehicle is operated by the motor with the engine stopped.

When determination in step S2101 is affirmative, the processing proceeds to step S2102 where the concentration detection routine to be described later is executed. When determination in step S2101 is negative, the processing proceeds to step S2106. In step S2106, it is determined whether an ignition key is turned off. When determination is negative, the processing returns to step S2101. When the ignition key is turned off, this flow is finished.

Figure 19:
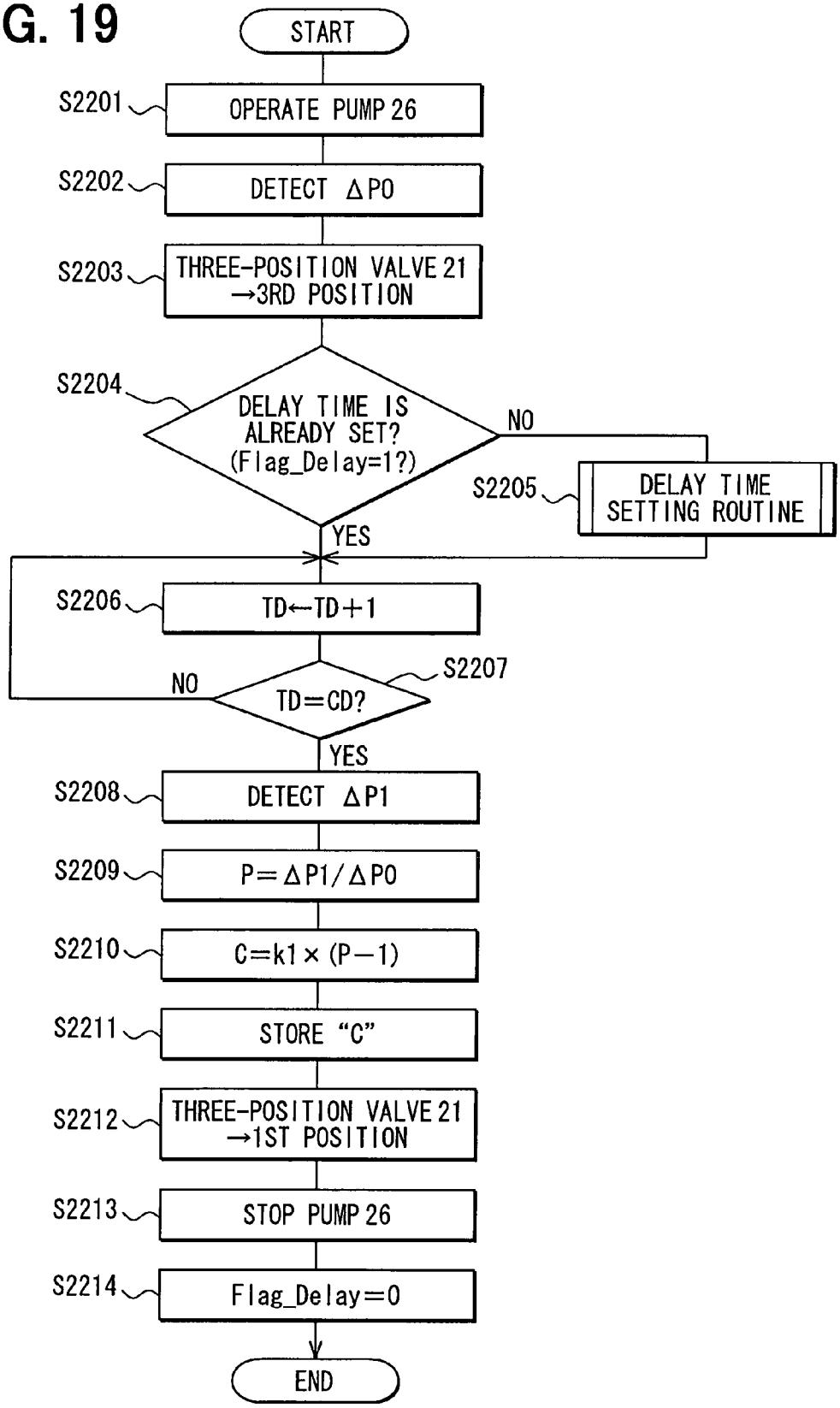
FIG. 19 is a flow chart showing a concentration detection routine shown in FIG. 18.

The content of the concentration detection routine is shown in FIG. 19. The progression of states of the respective parts of the apparatus during a period in which the concentration detection routine is executed is shown in FIG. 20.

Figure 20:
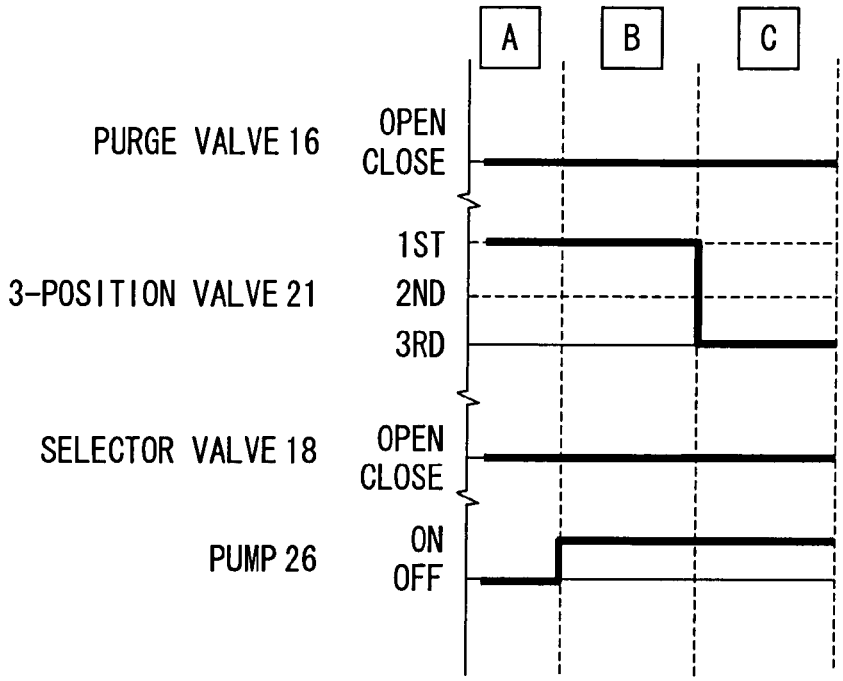
FIG. 20 is a diagram showing the processing of states of respective parts of an apparatus while the concentration detection routine is being executed.

In the initial state in the execution of the concentration detection routine, the purge valve 16 is closed and the three-position valve 21 is set to the first position and the selector valve 18 is closed and the pump 26 is stopped (state A shown in FIG. 20).

When the pump 26 is operated from this state in step S2201, this state A is changed to a state B shown in FIG. 20. The flowing state of gas at this time is shown by an arrow in FIG. 2. The state shown in FIG. 2 is the first measurement state in which air taken from the air supply line 20 passes through the three-position valve 21 and the restrictor 23 of the measurement line 22 and then flows out from the discharge line 27 to the atmosphere.

When the air flows through the restrictor 23, a pressure loss is caused by the restrictor 23. Thus, when the state is changed to the second measurement state, after a transient pressure change period, a differential pressure ΔP is caused by the pressure loss by the restrictor 23.

In step S2202, the differential pressure ΔP is detected after a specified time T1 passes from when the state is changed to the second measurement state, that is, step S2201 is executed (this differential pressure is hereinafter referred to as ΔP0). This differential pressure ΔP0 shows the pressure drop of the air caused by the restrictor 23.

In step S2203, the three-position valve 21 is set to the third position. With this, the state is changed to a state C shown in FIG. 20. The flowing state of the gas at this time is shown in FIG. 3. The state shown in FIG. 3 is the second measurement state in which the measurement line 22 communicates with the purge line 15 via the branch line 19. Moreover, the purge line 15 communicates with the canister 13 and communicates with the fuel tank 11 via the canister 13 and the evaporation line 12. In this first measurement state, air is introduced from the atmosphere line 17 to the canister 13 and the air-fuel mixture produced by the air and containing the evaporated fuel flows through the purge line 15, the branch line 19, the three-position valve 21, and the restrictor 23 of the measurement line 22.

In step S2204, it is determined whether a delay time CD is already set. Specifically, it is determined whether a flag Flag_Delay is 1. When this determination is affirmative, the processing proceeds directly to step S2206. On the other hand, when this determination is negative, a delay time setting routine is executed in step S2205.

Figure 21:
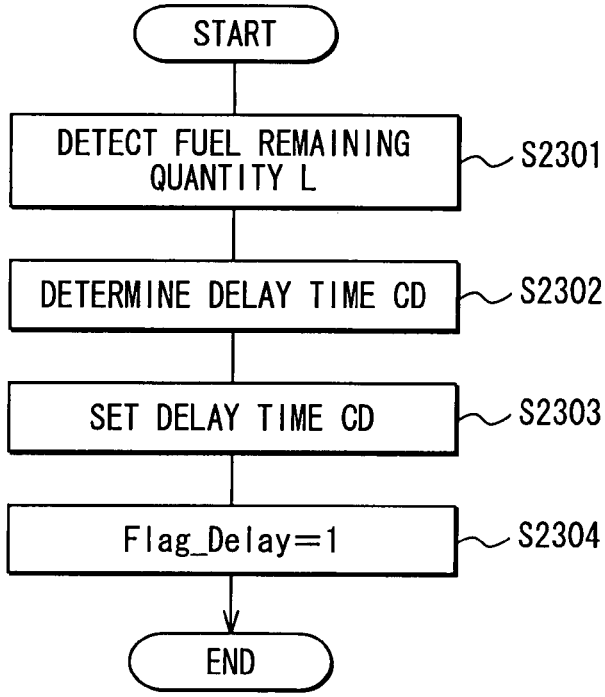
FIG. 21 is a flow chart showing a delay time setting routine in a first embodiment.

The delay time setting routine is shown in FIG. 21. In step S2301 shown in FIG. 21, a fuel remaining quantity (L) in the fuel tank 11 is detected by the use of a fuel remaining level sensor 40. The fuel remaining quantity is space volume information corresponding one-to-one to the space volume of the fuel tank 11. As the fuel remaining quantity becomes smaller, the space volume in the fuel tank 11 becomes larger. Moreover, the fuel remaining level sensor 40 for detecting the fuel remaining quantity of the space volume information is space volume information determination means.

Figure 22:
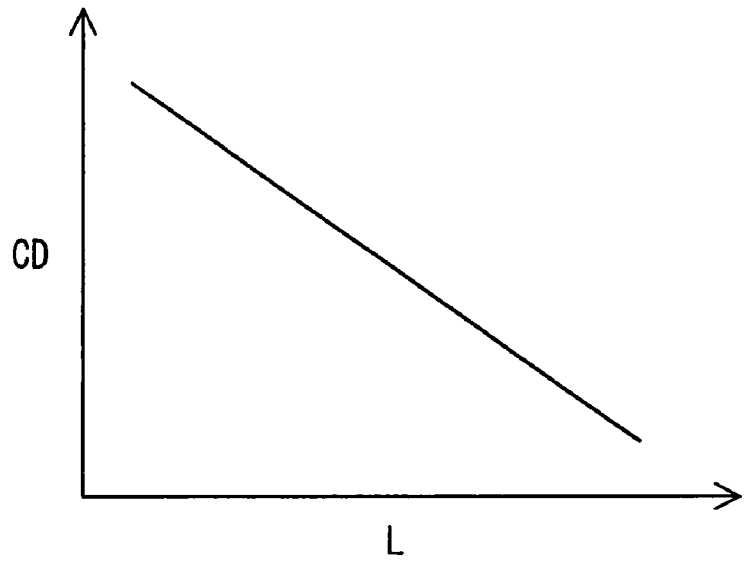
FIG. 22 is a diagram showing, by way of example, a time determination relationship used in step S2302 shown in FIG. 21.

Step S2302 corresponds to stabilization time determination means and determines a delay time CD on the basis of the fuel remaining quantity detected by step S2301 and a time determination relationship stored in the ROM in the ECU 30. The foregoing time determination relationship is, for example, a relationship shown in FIG. 22 in which the delay time CD decreases in proportion to an increase in the fuel remaining quantity.

The time determination relationship is previously determined on the basis of experiment in such a way that pressure in the fuel tank 11 is stabilized when the delay time CD determined on the basis of this relationship passes after the state is changed to the second measuring state. In other words, the delay time CD corresponds to a stabilization time that elapses after the state is changed to the second measurement state until the pressure in the fuel tank 11 is stabilized. In this regard, the reason why as the fuel remaining quantity becomes larger, the delay time CD becomes shorter is that as the fuel remaining quantity becomes larger, the space volume in the fuel tank 11 becomes smaller and that as the space volume becomes smaller, the time required for pressure in the space to reach equilibrium becomes shorter.

When the delay time CD is determined in step S2302, in step S2303, the delay time CD determined in step S2302 is set for use in the concentration detection routine shown in FIG. 19. Then, in step S2304, the delay time computation flag Flag_Delay is set to 1 and then this routine is finished.

Returning to FIG. 19, also when the delay time CD is set in step S2205, step S2206 is subsequently executed. In step S2206, 1 is added to a TimerDelay (hereinafter referred to as TD). Here, TD is cleared to 0 when the execution of the concentration detection routine is started.

In the next step S2207, it is determined whether TD reaches the delay time CD. When this determination is negative, the processing returns to step S2206 where TD is increased and then this step S2207 is executed again.

On the other hand, when determination in step S2207 is affirmative, in step S2208, the differential pressure ΔP (hereinafter referred to as ΔP1) is detected. This differential pressure ΔP1 expresses the pressure drop of the air-fuel mixture caused by the restrictor 23.

When the differential pressure ΔP1 is detected in the foregoing step S2208, the processing proceeds to step 2209. Steps S2209 and S2210 are processing as evaporated-fuel concentration computation means. In step S2209, a differential pressure ratio P is computed by an equation 16 on the basis of the two differential pressures ΔP0 and ΔP1 obtained in steps S2202 and S2208.

$$P=\Delta P1/\Delta P0 \quad \text{(Equation 16)}$$

In step S2210, the evaporated fuel concentration C is computed by an equation 17 on the basis of the differential pressure ratio P. In the equation 17, k1 is a constant and is previously stored in the ROM of the ECU 30 along with the control programs.

$$C=k1\times(P-1)(=(\Delta P1-\Delta P0)/\Delta P0) \quad \text{(Equation 17)}$$

Since the evaporated fuel is heavier than air, when the purge gas contains the evaporated fuel, the density of the purge gas becomes larger. When the number of revolutions of the pump 26 is the same and the velocity of flow (flow rate) in the evaporated fuel flow passage 21 is the same, by the law of energy conservation, as the density of the purge gas is larger, a differential pressure caused by the restrictor 23 becomes larger. As the evaporated fuel concentration is larger, the density of the purge gas becomes larger, so as the evaporated fuel concentration is larger, the differential pressure ratio P becomes larger. As a result, a characteristic line that the evaporated fuel concentration C and the differential pressure ratio P follow becomes a straight line. The equation 17 expresses such a characteristic line and a constant k1 is previously determined, as appropriate, by experiment or the like.

Next, in step S2211, the obtained evaporated fuel concentration C is temporarily stored. Then, in step S2212, the three-position valve 21 is returned to the first position and in step S2213 the pump 26 is stopped. This state is the same as the state A shown in FIG. 20, which results in returning to the state before starting the concentration detection routine.

In the next step S2214, the delay time computation flag Flag_Delay is set to 0 and then this routine is finished. The delay time computation flag is set to 0 in this step S2214, so every time the concentration detection routine is executed, the delay time CD is set on the basis of the fuel remaining quantity at that time.

Returning to FIG. 18, the concentration detection routine (step S2102) is executed and then in step S2103 it is determined whether purge condition is satisfied. Whether the purge condition is satisfied is determined on the basis of the operating state such as engine water temperature, oil temperature, and the number of revolutions of the engine like the ordinary evaporated fuel processing apparatus.

When determination in step S2103 is affirmative, the purge performing routine is executed in step S2104. In the purge performing routine, the engine operating state is detected and a purge gas flow rate to be introduced into the intake pipe 2 is computed on the basis of the detected engine operating state. Thus, this step S2104 corresponds to flow rate control means.

Specifically, this purge gas flow rate is computed on the basis of the fuel injection quantity required under the engine operating state such as the present throttle opening, the lower limit value of the fuel injection quantity to be controlled by the injector 4, and the pressure in the intake pipe 2. The opening of the purge valve 16 to realize this purge flow rate is computed on the basis of the evaporated fuel concentration C stored in FIG. 19. The opening of the purge valve 16 is controlled according to the opening computed in this manner until the purge stop conditions are satisfied.

Moreover, the three-position valve 21 is changed to the first position in the period during which this purge performing routine is executed. With this, the evaporated fuel is desorbed from the canister 13 and the air-fuel mixture containing the evaporated fuel is purged from the purge line 15 to the intake pipe 2.

When the foregoing purge performing routine is finished, the processing proceeds to step S2105. Moreover, when determination in step S2103 is negative, the processing proceeds directly to step S2105. In step S2105, it is determined whether a specified time elapses from when the concentration detection routine shown in FIG. 19 is executed. When determination is negative, step S2103 is repeatedly performed. When determination in step S2105 is affirmative, the processing returns to step S2101 where the processing for obtaining the evaporated fuel concentration C is executed again, and the evaporated fuel concentration C is updated to the newest value (steps S2101 and S2102). The specified time in step S2105 is set on the basis of the accuracy of a concentration value required in consideration of a time change in the evaporated fuel concentration C.

According to this embodiment described above, the delay time CD that elapses from the time of the second measurement state until the differential pressure ΔP1 is detected varies on the basis of the fuel remaining quantity in the second measurement state. Thus, as compared with a case in which the differential pressure ΔP1 is detected after a sufficient time elapses from the second measurement state, the differential pressure ΔP1 can be quickly detected. Moreover, in correspondence with the fact that as the space volume in the fuel tank 11 becomes larger, it takes a longer time for pressure in the fuel tank to be stabilized, as the fuel remaining quantity becomes smaller, the delay time CD becomes longer. Accordingly, the detection accuracy of the differential pressure ΔP1 and the accuracy of the purge gas flow rate control performed on the basis of the differential pressure ΔP1 are not reduced.

Next, a third embodiment of the present invention will be described. The third embodiment is different from the second embodiment only in that a delay time setting routine shown in FIG. 23 is used in place of the delay time setting routine shown in FIG. 21 and in the time determination relation used in this routine.

Figure 23:
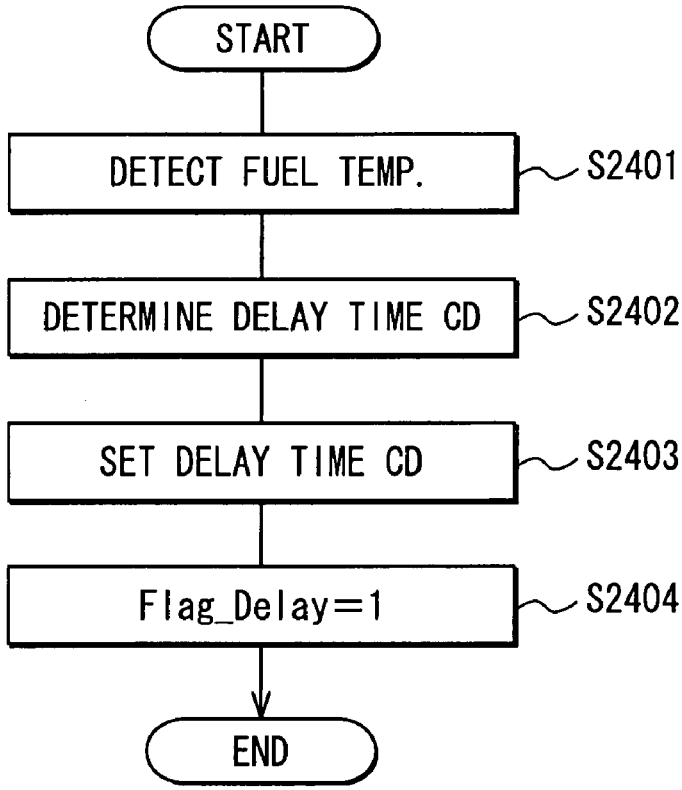
FIG. 23 is a flow chart showing a delay time setting routine in a second embodiment.
Figure 24:
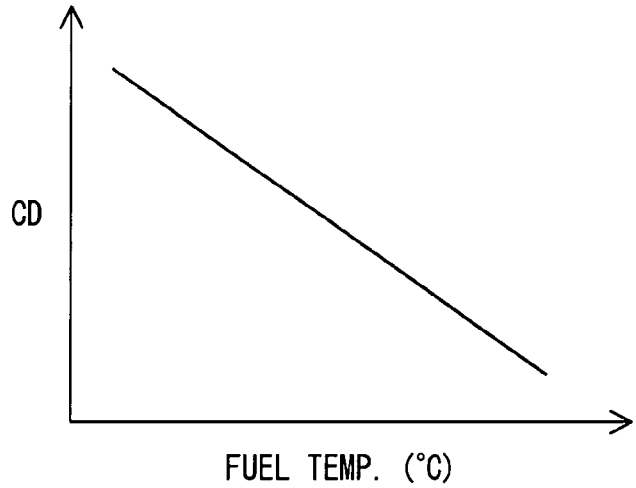
FIG. 24 is a diagram showing, by way of example, a time determination relationship used in step S2402 shown in FIG. 23.

In step S2401 shown in FIG. 23, the fuel temperature (° C.) in the fuel tank 11 is detected by the use of the fuel temperature sensor 41. In the next step S2402 corresponds to stabilization time determination means and the delay time CD is determined on the basis of the fuel temperature detected in step S2401 and the time determination relationship stored in the ROM in the ECU 30. The time determination relationship stored in the ROM in the third embodiment is, for example, a relationship shown in FIG. 24 in which the delay time CD becomes shorter in proportion to an increase in the fuel temperature.

This time determination relationship is previously determined on the basis of experiment, like the first embodiment, in such a way that when the delay time CD determined on the basis of this relationship elapses after the second measurement state, the pressure in the fuel tank 11 is stabilized. Also in the third embodiment, the delay time CD corresponds to the stabilization time. In this regard, the reason why as the fuel temperature becomes lower, the delay time CD becomes longer is that as the fuel temperature becomes lower, fuel evaporation quantity per unit time becomes smaller and that as the fuel evaporation quantity becomes smaller, the time required for pressure in a space to be stabilized becomes longer.

When the delay time CD is determined in step S2402, in step S2403 the delay time CD determined in step S2402 is set for use in the concentration detection routine shown in FIG. 19. In step S2404, the delay time computation flag Flag_Delay is set to 1 and then this routine is finished.

According to this third embodiment, the delay time CD that elapses from the second measurement state until the differential pressure ΔP1 is detected varies on the basis of the fuel temperature in the second measurement state. Thus, as compared with a case in which the differential pressure ΔP1 is detected after a sufficient time elapses after the second measurement state, the differential pressure ΔP1 can be quickly detected. Moreover, in response to the fact that as the fuel temperature becomes lower, it takes a longer time for the pressure in the tank to be stabilized, as the fuel temperature becomes lower, the delay time CD becomes longer. Accordingly, the detection accuracy of the differential pressure ΔP1 and the accuracy of the purge gas flow rate control to be performed on the differential pressure ΔP1 are not reduced.

Up to this point, the embodiments of the present invention have been described. However, the present invention is not limited to the foregoing embodiments but the following embodiments are also included in the technical scope of the present invention and various modifications other than the following can be made without departing from the scope and spirit of the present invention.

Figure 25:
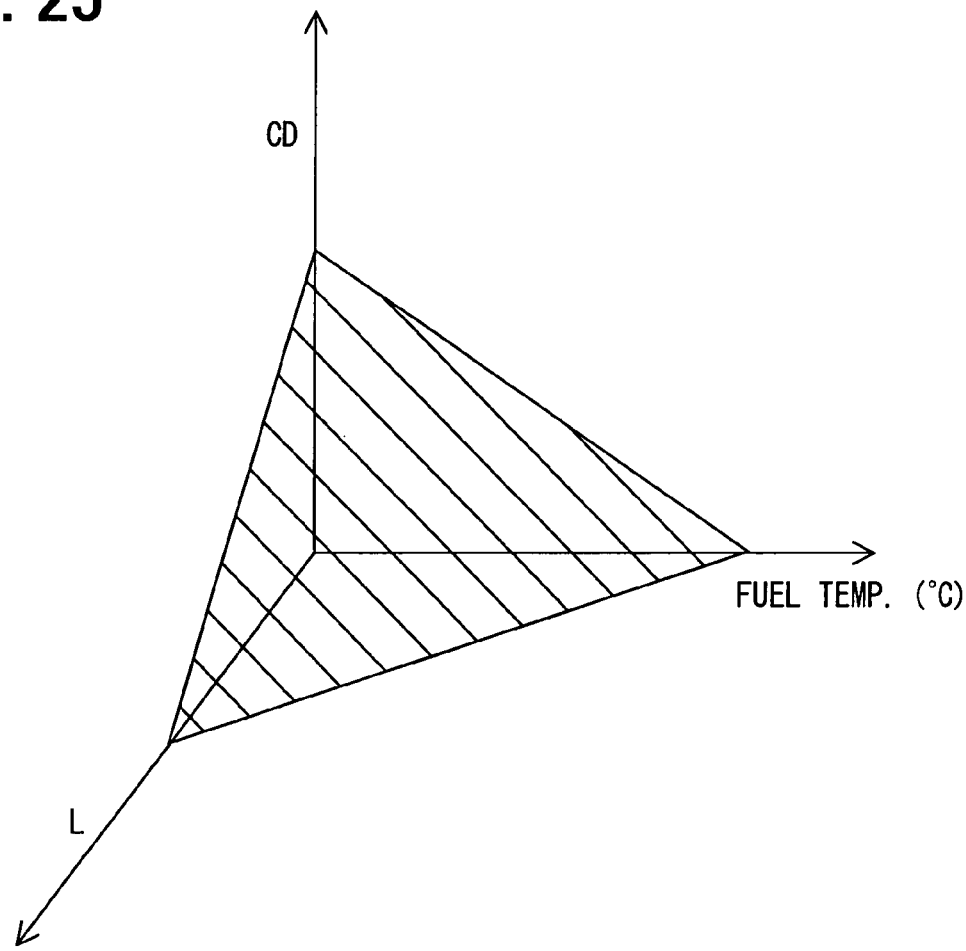
FIG. 25 is a diagram showing, by way of example, a time determination relationship for determining a delay time CD from a fuel remaining quantity and a fuel temperature.

For example, in the second embodiment, the delay time CD is set on the basis of the fuel remaining quantity, while in the third embodiment the delay time CD is set on the basis of the fuel temperature. However, the delay time CD may be set on the basis of both of them. In this case, the time determination relationship for determining the delay time CD is set, as shown in FIG. 25, in such a way that as the fuel remaining quantity becomes larger or the fuel temperature becomes higher, the delay time CD becomes shorter. In this regard, a three-dimensional map may be used for this relationship.

Moreover, while the fuel temperature is detected by the fuel temperature sensor 41 in the third embodiment, the fuel temperature is not necessarily actually measured. The fuel temperature may be estimated on the basis of the temperature detected at the other position. For example, it is also recommendable to previously set the relationship between temperature in the vehicle compartment and the fuel temperature and to estimate the fuel temperature on the basis of the temperature in the vehicle compartment actually detected by a vehicle compartment temperature sensor and the foregoing relationship.

What is claimed is:

1. An evaporated fuel processing apparatus of an internal combustion engine in which evaporated fuel in a fuel tank is introduced into a canister via an evaporated fuel passage and is temporarily adsorbed by an adsorbent material in the canister and in which when the internal combustion engine is operated, the evaporated fuel adsorbed by the adsorbent material is discharged from the canister via a purge pipe into an intake pipe of the internal combustion engine, the evaporated fuel processing apparatus comprising:

a measurement passage having a restrictor;

a pump for generating a gas flow passing through the restrictor disposed in the measurement passage;

switching means for switching between a state in which the measurement passage communicates with the purge pipe, the canister, and the fuel tank and a state in which the measurement passage does not communicate with the purge pipe;

pressure detection means for detecting a pressure change quantity in an air-fuel mixture containing the evaporated fuel discharged from the canister, the pressure change quantity being caused by the restrictor, in a measurement state in which the gas flow is generated by the pump to flow the air-fuel mixture through the restrictor, the gas flow being generated in a state in which the measurement passage is switched by the switching means to be made to communicate with the purge pipe, the canister, and the fuel tank;

flow rate control means for controlling a flow rate of the air-fuel mixture introduced from the canister into the intake pipe on the basis of the pressure change quantity in the air-fuel mixture detected by the pressure detection means and a pressure change quantity in air flowing through a specified restrictor;

space volume information determination means for determining space volume information corresponding to a space volume in the fuel tank;

storage means for storing a relationship between the space volume information and a stabilization time of pressure in the fuel tank, the relationship being a relationship in which as the space volume in the fuel tank becomes larger, the stabilization time becomes longer; and stabilization time determination means for determining the stabilization time on the basis of the space volume information actually determined by the space volume information determination means when the pressure change quantity in the air-fuel mixture is measured by the pressure detection means and the relationship stored in the storage means, wherein when a time that elapses after the measurement state is achieved becomes larger than the stabilization time determined by the stabilization time determination means, the pressure detection means detects the pressure change quantity in the air-fuel mixture.

2. The evaporated fuel processing apparatus of an internal combustion engine according to claim 1, further comprising fuel temperature determination means for determining a fuel temperature in the fuel tank, wherein the relationship stored in the storage means is a relationship in which the stabilization time is determined on the basis of the space volume information and the fuel temperature in the fuel tank, and wherein the stabilization time determination means determines the stabilization time on the basis of the space volume information and the fuel temperature, which are actually determined respectively by the space volume information determination means and the fuel temperature determination means when the pressure detection means measures the pressure change quantity in the air-fuel mixture, and the relationship stored in the storage means.

3. An evaporated fuel processing apparatus of an internal combustion engine in which evaporated fuel in a fuel tank is introduced into a canister via an evaporated fuel passage and is temporarily adsorbed by an adsorbent material in the canister and in which when the internal combustion engine is operated, the evaporated fuel adsorbed by the adsorbent material is discharged from the canister into an intake pipe of the internal combustion engine via a purge pipe, the evaporated fuel processing apparatus comprising:

a measurement passage having a restrictor;

a pump for generating a gas flow passing through the restrictor disposed in the measurement passage;

switching means for switching between a state in which the measurement passage communicates with the purge pipe, the canister, and the fuel tank and a state in which the measurement passage does not communicate with the purge pipe;

pressure detection means for detecting a pressure change quantity in an air-fuel mixture containing the evaporated fuel discharged from the canister, the pressure change quantity being caused by the restrictor, in a measurement state in which the gas flow is generated by the pump to flow the air-fuel mixture through the restrictor, the gas flow being generated in a state in which the measurement passage is switched by the switching means to be made to communicate with the purge pipe, the canister, and the fuel tank;

flow rate control means for controlling a flow rate of the air-fuel mixture introduced from the canister into the intake pipe on the basis of the pressure change quantity in the air-fuel mixture detected by the pressure detection means and a pressure change quantity in air flowing through a specified restrictor;

fuel temperature determination means for determining a fuel temperature in the fuel tank;

storage means for storing a relationship between the fuel temperature in the fuel tank and a stabilization time of pressure in the fuel tank, the relationship being a relationship in which as the fuel temperature becomes lower, the stabilization time becomes longer; and stabilization time determination means for determining the stabilization time on the basis of the fuel temperature actually determined by the fuel temperature determination means when the pressure change quantity in the air-fuel mixture is measured by the pressure detection means and the relationship stored in the storage means, wherein when a time that elapses after the measurement state is achieved becomes larger than the stabilization time determined by the stabilization time determination means, the pressure detection means detects the pressure change quantity in the air-fuel mixture.

* * * * *